US007762355B2

(12) United States Patent
McClain et al.

(10) Patent No.: US 7,762,355 B2
(45) Date of Patent: Jul. 27, 2010

(54) ROTARY DRAG BIT AND METHODS THEREFOR

(75) Inventors: Eric E. McClain, Spring, TX (US); David Gavia, The Woodlands, TX (US); Lane E. Snell, Denver, CO (US); Jason E. Hoines, Montgomery, TX (US); Matthew R. Isbell, Houston, TX (US); Michael L. Doster, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 64 days.

(21) Appl. No.: 12/020,492

(22) Filed: Jan. 25, 2008

(65) Prior Publication Data

US 2008/0179108 A1 Jul. 31, 2008

Related U.S. Application Data

(60) Provisional application No. 60/897,457, filed on Jan. 25, 2007.

(51) Int. Cl.
*E21B 10/46* (2006.01)

(52) U.S. Cl. ..... 175/57; 175/431

(58) Field of Classification Search ..... 175/431, 175/434, 57

See application file for complete search history.

(56) References Cited

U.S. PATENT DOCUMENTS

| | | | |
|---|---|---|---|
| 3,707,747 | A | 1/1973 | Falk |
| 4,471,845 | A | 9/1984 | Jurgens |
| 4,538,690 | A | 9/1985 | Short, Jr. |
| 4,602,691 | A | 7/1986 | Weaver |
| 4,815,342 | A | 3/1989 | Brett et al. |
| 4,892,159 | A | 1/1990 | Holster |
| 4,981,184 | A | 1/1991 | Knowlton et al. |
| 5,010,789 | A | 4/1991 | Brett et al. |

(Continued)

FOREIGN PATENT DOCUMENTS

| | | |
|---|---|---|
| EP | 0872625 | 10/1998 |

(Continued)

OTHER PUBLICATIONS

PCT International Search Report for International Application No. PCT/US2008/052128, mailed Jul. 2, 2008.

(Continued)

*Primary Examiner*—William P Neuder
(74) *Attorney, Agent, or Firm*—TraskBritt

(57) ABSTRACT

A rotary drag bit includes a primary cutter row comprising at least one primary cutter, and at least two additional cutters configured relative to one another. In one embodiment, the cutters are backup cutters of a backup cutter group located in respective first and second trailing cutter rows, oriented relative to one another, and positioned to substantially follow the at least one primary cutter. The rotary drag bit life is extended by the backup cutter group, making the bit more durable and extending the life of the cutters. In other of the embodiments, the cutters are configured to selectively engage a subterranean formation material being drilled, providing improved bit life and reduced stress upon the cutters. Still other embodiments of rotary drag bits include backup cutter configurations having different backrake angles and siderake angles, including methods therefor.

33 Claims, 26 Drawing Sheets

U.S. PATENT DOCUMENTS

| | | | |
|---|---|---|---|
| 5,119,892 | A | 6/1992 | Clegg et al. |
| 5,131,478 | A | 7/1992 | Brett et al. |
| 5,145,017 | A | 9/1992 | Holster et al. |
| 5,238,075 | A | 8/1993 | Keith et al. |
| RE34,435 | E | 11/1993 | Warren et al. |
| 5,314,033 | A | 5/1994 | Tibbitts |
| 5,332,051 | A | 7/1994 | Knowlton |
| 5,443,565 | A | 8/1995 | Strange, Jr. |
| 5,531,281 | A | 7/1996 | Murdock |
| 5,549,171 | A | 8/1996 | Mensa-Wilmot et al. |
| 5,582,261 | A | 12/1996 | Keith et al. |
| 5,595,252 | A | 1/1997 | O'Hanlon |
| 5,607,025 | A | 3/1997 | Mensa-Wilmot et al. |
| 5,722,499 | A | 3/1998 | Nguyen et al. |
| 5,816,346 | A | 10/1998 | Beaton |
| 5,904,213 | A | 5/1999 | Caraway et al. |
| 5,937,958 | A | 8/1999 | Mensa-Wilmot et al. |
| 5,957,227 | A | 9/1999 | Besson et al. |
| 5,992,547 | A | 11/1999 | Caraway et al. |
| 6,123,161 | A | 9/2000 | Taylor |
| 6,283,233 | B1 | 9/2001 | Lamine et al. |
| 6,298,930 | B1 | 10/2001 | Sinor et al. |
| 6,308,790 | B1 | 10/2001 | Mensa-Wilmot et al. |
| 6,349,780 | B1 | 2/2002 | Beuershausen |
| 6,394,200 | B1 | 5/2002 | Watson et al. |
| 6,408,958 | B1 | 6/2002 | Isbell et al. |
| 6,460,631 | B2 | 10/2002 | Dykstra et al. |
| 6,510,906 | B1 | 1/2003 | Richert et al. |
| 6,536,543 | B2 | 3/2003 | Meiners et al. |
| 6,564,886 | B1 | 5/2003 | Mensa-Wilmot et al. |
| 6,659,207 | B2 | 12/2003 | Hoffmaster et al. |
| 6,711,969 | B2 | 3/2004 | Meiners et al. |
| 6,729,420 | B2 | 5/2004 | Mensa-Wilmot |
| 6,779,613 | B2 | 8/2004 | Dykstra et al. |
| 6,883,623 | B2 * | 4/2005 | McCormick et al. ..... 175/408 |
| 6,935,441 | B2 | 8/2005 | Dykstra et al. |
| 7,000,715 | B2 | 2/2006 | Sinor et al. |
| 7,025,156 | B1 | 4/2006 | Caraway |
| 7,096,978 | B2 | 8/2006 | Dykstra et al. |
| 7,178,609 | B2 | 2/2007 | Hart et al. |
| 7,243,745 | B2 | 7/2007 | Skeem et al. |
| 7,621,348 | B2 | 11/2009 | Hoffmaster et al. |
| 2006/0070771 | A1 | 4/2006 | McClain et al. |
| 2006/0162968 | A1 | 7/2006 | Durairajan et al. |
| 2006/0180356 | A1 | 8/2006 | Durairajan et al. |
| 2007/0144789 | A1 | 6/2007 | Johnson et al. |
| 2007/0240905 | A1 | 10/2007 | Mensa-Wilmot |
| 2007/0267227 | A1 | 11/2007 | Mensa-Wilmot |
| 2008/0135297 | A1 * | 6/2008 | Gavia ..... 175/57 |
| 2008/0179106 | A1 | 7/2008 | Gavia et al. |
| 2008/0179107 | A1 | 7/2008 | Doster |
| 2009/0266619 | A1 | 10/2009 | Durairajan et al. |
| 2010/0000800 | A1 | 1/2010 | Chen et al. |

FOREIGN PATENT DOCUMENTS

| | | |
|---|---|---|
| EP | 0884449 | 12/1998 |
| GB | 2294072 | 4/1996 |
| GB | 2365893 | 2/2002 |
| GB | 2438053 | 11/2007 |
| WO | 9603567 A1 | 2/1996 |

OTHER PUBLICATIONS

PCT International Search Report for International Application No. PCT/US2007/025101, mailed Jun. 19, 2008.
PCT International Search Report for International Application No. PCT/US2008/000914, mailed Jul. 7, 2008.
PCT International Search Report for International Application No. PCT/US2008/052108, mailed Jul. 8, 2008.

* cited by examiner

ROTARY DRAG BIT AND METHODS THEREFOR

CROSS-REFERENCE TO RELATED APPLICATION

This application claims the benefit of U.S. Provisional Patent Application Ser. No. 60/897,457, filed Jan. 25, 2007, pending, for "ROTARY DRAG BIT," the entire disclosure of which is hereby incorporated herein by this reference.

This application is also related to U.S. patent application Ser. No. 11/862,440, filed Sep. 27, 2007, pending, for ROTARY DRAG BITS HAVING A PILOT CUTTER CONFIGURATION AND METHOD TO PRE-FRACTURE SUBTERRANEAN FORMATIONS THEREWITH, which claims the benefit of U.S. Provisional Patent Application Ser. No. 60/873,349, filed Dec. 7, 2006, for "ROTARY DRAG BITS HAVING A PILOT CUTTER CONFIGURATION AND METHOD TO PRE-FRACTURE SUBTERRANEAN FORMATIONS THEREWITH. This application is also related to U.S. patent application Ser. No. 12/019,814, filed Jan. 25, 2008, pending, for ROTARY DRAG BIT, which claims the benefit of U.S. Provisional Patent Application Ser. No. 60/897,457 filed Jan. 25, 2007, for ROTARY DRAG BIT. This application is also related to U.S. patent application Ser. No. 12/020,399, filed Jan. 25, 2008, pending, for ROTARY DRAG BIT AND METHODS THEREFOR, which claims the benefit of U.S. Provisional Patent Application Ser. No. 60/897,457 filed Jan. 25, 2007, for ROTARY DRAG BIT.

TECHNICAL FIELD

The present invention, in several embodiments, relates generally to a rotary drag bit for drilling subterranean formations and, more particularly, to rotary drag bits having backup cutters with different cutter configurations configured to enhance cutter life and performance, including methods therefor.

BACKGROUND

Rotary drag bits have been used for subterranean drilling for many decades, and various sizes, shapes and patterns of natural and synthetic diamonds have been used on drag bit crowns as cutting elements. A drag bit can provide an improved rate of penetration (ROP) over a tri-cone bit in many formations.

Over the past few decades, rotary drag bit performance has been improved with the use of a polycrystalline diamond compact (PDC) cutting element or cutter, comprising a planar diamond cutting element or table formed onto a tungsten carbide substrate under high temperature and high pressure conditions. The PDC cutters are formed into a myriad of shapes, including circular, semicircular or tombstone, which are the most commonly used configurations. Typically, the PDC diamond tables are formed so the edges of the table are coplanar with the supporting tungsten carbide substrate or the table may overhang or be undercut slightly, forming a "lip" at the trailing edge of the table in order to improve the cutting effectiveness and wear life of the cutter as it comes into contact with formations of earth being drilled. Bits carrying PDC cutters, which, for example, may be brazed into pockets in the bit face, pockets in blades extending from the face, or mounted to studs inserted into the bit body, have proven very effective in achieving a ROP in drilling subterranean formations exhibiting low to medium compressive strengths. The PDC cutters have provided drill bit designers with a wide variety of improved cutter deployments and orientations, crown configurations, nozzle placements and other design alternatives previously not possible with the use of small natural diamond or synthetic diamond cutters. While the PDC cutting element improves drill bit efficiency in drilling many subterranean formations, the PDC cutting element is nonetheless prone to wear when exposed to certain drilling conditions, resulting in a shortened life of a rotary drag bit using such cutting elements.

Thermally stable diamond (TSP) is another type of synthetic diamond, PDC material which can be used as a cutting element or cutter for a rotary drag bit. TSP cutters, which have had a catalyst used to promote formation of diamond-to-diamond bonds in the structure removed therefrom, have improved thermal performance over PDC cutters. The high frictional heating associated with hard and abrasive rock drilling applications creates cutting edge temperatures that exceed the thermal stability of PDC, whereas TSP cutters remain stable at higher operating temperatures. This characteristic also enables TSPs to be furnaced into the face of a matrix-type rotary drag bit.

While the PDC or TSP cutting elements provide better ROP and manifest less wear during drilling as compared to some other cutting element types, it is still desirable to further the life of rotary drag bits and improve cutter life regardless of the cutter type used. Researchers in the industry have long recognized that as the cutting elements wear, i.e., wearflat surfaces develop and are formed on each cutting element coming in contact with the subterranean formation during drilling, the penetration rate (or ROP) decreases. The decrease in the penetration rate is a manifestation that the cutting elements of the rotary drag bit are wearing out, particularly when other drilling parameters remain constant. Various drilling parameters include, without limitation, formation type, weight on bit (WOB), cutter position, cutter rake angle, cutter count, cutter density, drilling temperature and drill string RPM, for example, and further include other parameters understood by those of ordinary skill in the subterranean drilling art.

While researchers continue to develop and seek out improvements for longer lasting cutters or generalized improvements to cutter performance, they fail to accommodate or implement an engineered approach to achieving longer drag bit life by maintaining or increasing ROP by taking advantage of cutting element wear rates. In this regard, while ROP is many times a key attribute in identifying aspects of the drill bit performance, it would be desirable to utilize or take advantage of the nature of cutting element wear in extending or improving the life of the drag bit.

One approach to enhancing bit life is to use the so-called "backup" cutter to extend the life of a primary cutter of the drag bit particularly when subjected to dysfunctional energy or harder, more abrasive, material in the subterranean formation. Conventionally, the backup cutter is positioned in a second cutter row, rotationally following in the path of a primary cutter, so as to engage the formation should the primary cutter fail or wear beyond an appreciable amount. The use of backup cutters has proven to be a convenient technique for extending the life of a bit, while enhancing stability without the necessity of designing the bit with additional blades to carry more cutters which might decrease ROP or potentially compromise bit hydraulics due to reduced available fluid flow area over the bit face and less-than-optimum fluid flow due to unfavorable placement of nozzles in the bit face. Conventionally, it is understood by a person of skill in the art that a drag bit will experience less wear as the blade count is increased and undesirably will have slower ROP, while a drag bit with a lower blade count, with its faster ROP, is subjected to greater wear. Also, it is believed that conventional backup cutters in combination with their associated primary cutters may undesirably lead to bailing of the blade area with formation material. Accordingly, it would be desirable to utilize or take advantage of the use of backup cutters to increase the durability of the drag bit while providing increased ROP and without compromising bit hydraulics and formation cuttings removal. It would also be desirable to provide a drag bit having an improved, less restricted, flow area by further decreasing the number of blades conventionally required in order to achieve a more durable blade. Durability may be quantified in terms of cutter placement, and may further be considered in terms of the ability to maintain the sharpness of each cutter for a longer period of time while drilling. In this sense, "sharpness" of each cutter involves improving wear of the diamond table, including less chipping or damage to the diamond table caused by point loading, dysfunctional energy or drill string bounce.

Accordingly, there is an ongoing desire to improve or extend rotary drag bit life and performance regardless of the subterranean formation type being drilled. There is a further desire to extend the life of a rotary drag bit by beneficially orienting and positioning cutters upon the bit body.

SUMMARY OF THE INVENTION

Accordingly, embodiments of a rotary drag bit comprising a primary cutter row having at least one primary cutter, and at least two additional cutters configured relative to one another. In one embodiment, the cutters are backup cutters of a cutter group located in respective first and second trailing cutter rows, oriented relative to one another, and positioned to substantially follow the at least one primary cutter. The rotary drag bit life is extended by the backup cutter group, making the bit more durable and extending the life of the cutters. Further, the cutters may be selectively configured to engage and fracture a subterranean formation material being drilled, providing improved bit life and reduced stress upon the primary cutters.

In an embodiment of the invention, a rotary drag bit includes a bit body with a face and an axis; at least one blade extending longitudinally and radially over the face; a primary cutter row comprising at least one primary cutter, the at least one primary cutter including a cutting surface protruding at least partially from the blade, located to traverse a cutting path upon rotation of the bit body about the axis, and configured to engage a formation upon movement along the cutting path; and a backup cutter group comprising a first trailing cutter row and a second trailing cutter row, each trailing cutter row comprising at least one cutter including a cutter configuration and a cutting surface protruding at least partially from the blade, the at least one cutter of each of the first and second trailing cutter rows positioned so as to substantially follow the at least one primary cutter along the cutting path upon rotation of the bit body about its axis, and each cutter configured to selectively engage the formation upon movement along the cutting path.

In another embodiment of the invention, a rotary drag bit includes a bit body with a face and an axis; at least one blade extending longitudinally and radially over the face; a primary cutter row comprising a plurality of primary cutters, each of the plurality of primary cutters including a cutting surface protruding at least partially from the blade, located to traverse a cutting path upon rotation of the bit body about the axis, and configured to engage a formation upon movement alone the cutting path; a first trailing cutter row comprising at least one first cutter including a first cutter configuration and a cutting surface protruding at least partially from the blade, positioned so as to substantially follow at least one of the plurality of primary cutters along the cutting path, and configured to conditionally engage the formation upon movement along the cutting path; and a second trailing cutter row comprising at least one second cutter including a second cutter configuration different from the first cutter configuration and a cutting surface protruding at least partially from the blade, positioned so as to substantially follow at least one of the plurality of primary cutters along the cutting path, and configured to conditionally engage the formation upon movement along the cutting path.

In a further embodiment of the invention, a rotary drag bit includes a bit body with a face and an axis; at least one blade extending longitudinally and radially over the face; a primary cutter row comprising at least one primary cutter, the at least one primary cutter including a cutting surface protruding at least partially from the blade, located to traverse a cutting path upon rotation of the bit body about the axis, and configured to engage a formation upon movement along the cutting path; and a backup cutter row comprising a plurality of backup cutters comprising a first backup cutter rotationally following the at least one primary cutter, and a second backup cutter variably oriented with respect to the first backup cutter, the first backup cutter and the second backup cutter including a cutting surface protruding at least partially from the blade, configured to conditionally engage a formation upon movement along the cutting path.

In yet another embodiment of the invention, a rotary drag bit includes a bit body with a face and an axis; at least one blade extending longitudinally and radially over the face; a primary cutter row comprising a first primary cutter and a second primary cutter, each primary cutter including a cutting surface protruding at least partially from the blade, located to traverse a cutting path upon rotation of the bit body about the axis, and configured to engage a formation upon movement along the cutting path; a first backup cutter rotationally following the first primary cutter, the first backup cutter including a cutting surface protruding at least partially from the blade, configured to conditionally engage a formation upon movement along the cutting path; and a second backup cutter rotationally following the second primary cutter and oriented with respect to the first backup cutter, the second backup cutter including a cutting surface protruding at least partially from the blade, configured to conditionally engage a formation upon movement along the cutting path.

In still another embodiment of the invention, a rotary drag bit, comprises a bit body with a face and an axis; at least one blade extending longitudinally and radially over the face; a plurality of primary cutters, each primary cutter of the plurality of primary cutters including a cutting surface protruding at least partially from the blade, located to traverse a cutting path upon rotation of the bit body about the axis, and configured to engage a formation upon movement along the cutting path; a first backup cutter rotationally following a primary cutter of the plurality of primary cutters, the first backup cutter including a first siderake angle, a first backrake angle, and a cutting surface protruding at least partially from the blade, configured to conditionally engage a formation upon movement along the cutting path; and a second backup cutter rotationally following another primary cutter of the plurality of primary cutters, the second backup cutter including a different second siderake angle than the first siderake angle, a different second backrake angle than the first backrake angle, and a cutting surface protruding at least partially from the blade, configured to conditionally engage a formation upon movement along the cutting path.

In yet further embodiments of the invention, a rotary drag bit is provided that advantageously includes backup cutters positioned in at least one cutter row, and configured with backrake angles and siderake angles' various extents.

Other embodiments of rotary drag bits are provided that advantageously may include backup cutter configurations having backrake angles and siderake angles to varied extents.

Furthermore, a method of using a rotary drag bit and a method of designing a rotary drag bit are also provided.

Other advantages and features of the present invention will become apparent when viewed in light of the detailed description of the various embodiments of the invention when taken in conjunction with the attached drawings and appended claims.

DETAILED DESCRIPTION

In embodiments of the invention to be described below, rotary drag bits are provided that may drill further, may drill faster or may be more durable than rotary drag bits of conventional design. In this respect, each drag bit is believed to offer improved life and greater performance regardless of the subterranean formation material being drilled.

Figure 1:
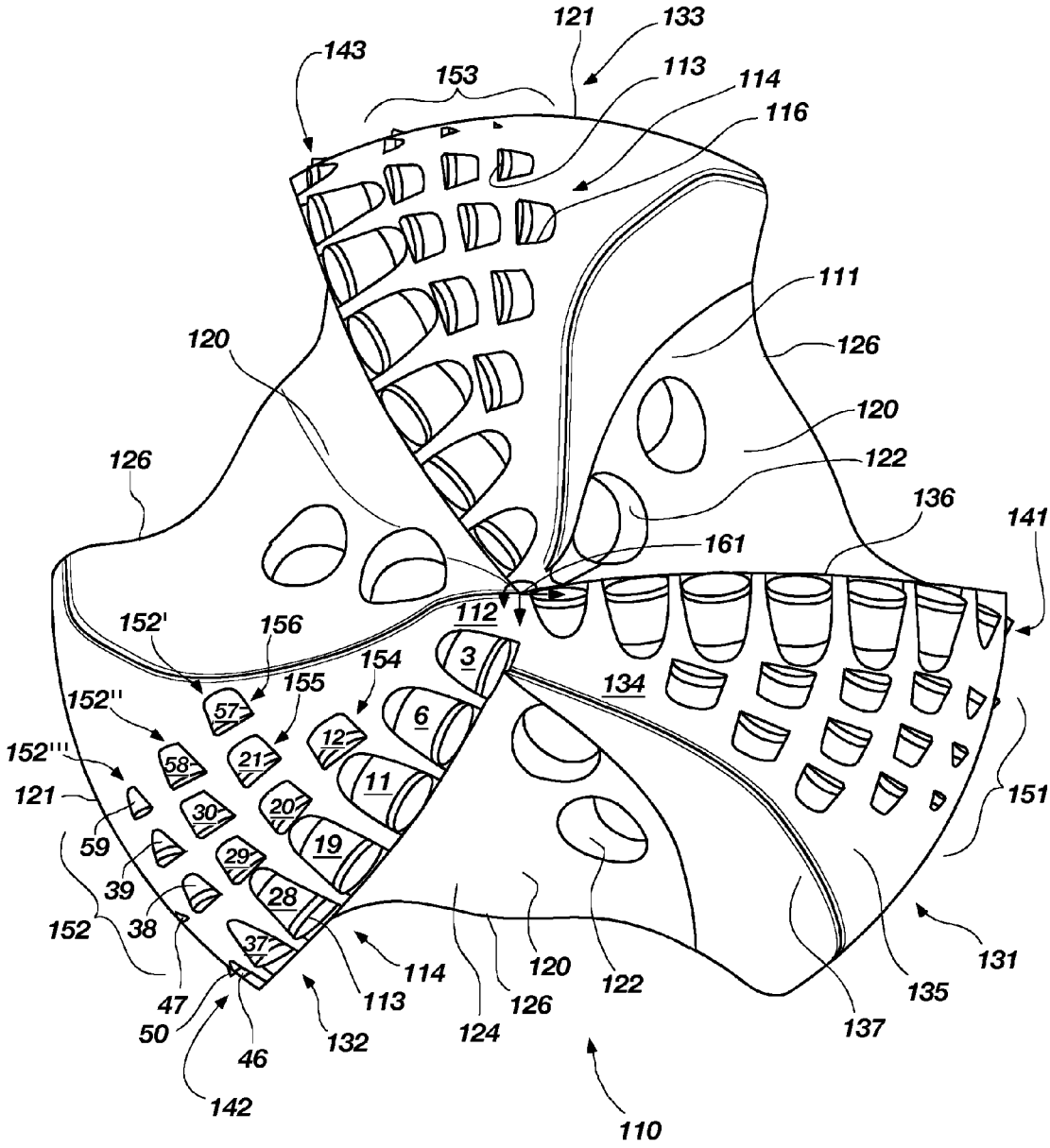
FIG. 1 shows a frontal view of a rotary drag bit in accordance with a first embodiment of the invention.

In FIG. 1, the rotary drag bit 110 is oriented as if it were viewed from the bottom, or by looking upwardly at its face or leading end 112 with the viewer positioned at the bottom of a bore hole. Rotary drag bit 110 includes a plurality of cutting elements or cutters 114 bonded, as by brazing, into pockets 116 (as representatively shown) located in the blades 131, 132, 133 protruding from the face 112 of the rotary drag bit 110. While the cutters 114 may be bonded to the pockets 116 by brazing, other attachment techniques may be used as are well known to those of ordinary skill in the art. Reference number 114 is generally used to represent each of the cutters. The cutters 114 are depicted as coupled to their respective pockets 116 upon the rotary drag bit 110, but specific cutters, including their attributes, will be called out by different reference numerals hereinafter to provide a more detailed presentation of the invention.

The rotary drag bit 110 in this embodiment is a so-called "matrix" body bit. "Matrix" bits include a mass of metal powder, such as tungsten carbide particles, infiltrated with a molten, subsequently hardenable binder, such as a copper-based alloy. Optionally, the bit may also be a steel or other bit type, such as a sintered metal carbide. Steel bits are generally made from a forging or billet, then machined to a final shape. The invention is not limited by the type of bit body employed for implementation of any embodiment thereof.

Fluid courses 120 lie between blades 131, 132, 133 and are provided with drilling fluid by ports 122 being at the end of passages leading from a plenum extending into a bit body 111 from a tubular shank at the upper, or trailing, end of the rotary drag bit 110. The ports 122 may include nozzles (not shown) secured thereto for enhancing and controlling flow of the drilling fluid. Fluid courses 120 extend to junk slots 126 traversing upwardly along the longitudinal side 124 of rotary drag bit 110 between blades 131, 132, 133. Gage pads (not shown) comprise longitudinally oriented protrusions having radial outer surfaces 121 extending from blades 131, 132, 133 and may include wear-resistant inserts or coatings as known in the art. In use, drilling fluid (not shown) emanating from ports 122, sweeps formation cuttings away from the cutters 114 and moves generally radially outwardly through fluid courses 120 and then upwardly through junk slots 126 to an annulus between the drill string from which the rotary drag bit 110 is suspended and supported and the surfaces of the bore hole. Advantageously, the drilling fluid also cools the cutters 114 during drilling while clearing formation cuttings from the bit face 112.

Each of the cutters 114 in this embodiment is a PDC cutter. However, it is recognized that any other suitable type of cutting element may be utilized with the embodiments of the invention presented. For clarity in the various embodiments of the invention, the cutters are shown as unitary structures in order to better describe and present the invention. However, it is recognized that the cutters 114 may comprise layers of materials. In this regard, the PDC cutters 114 of the current embodiment each comprise a diamond table bonded to a supporting substrate, as previously described. The PDC cutters 114 remove material from the underlying subterranean formations by a shearing action as the rotary drag bit 110 is rotated by contacting the formation with cutting edges 113 of the cutters 114. As the formation is cut and comminuted by the cutters 144, the flow of drilling fluid suspends and carries the formation cuttings away through the junk slots 126.

Figure 2:
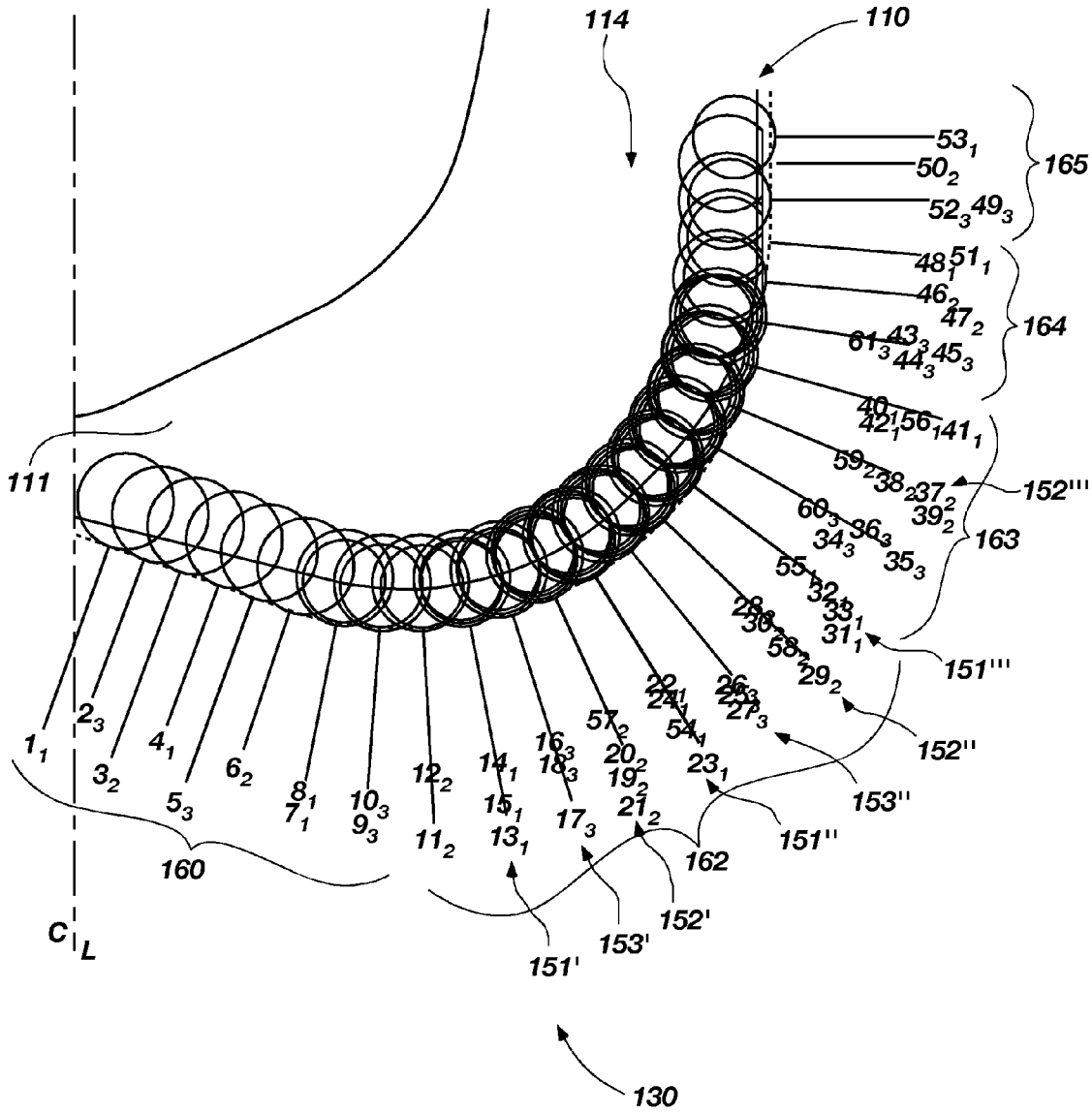
FIG. 2 shows a cutter and blade profile for the first embodiment of the invention.

The blades 131, 132, 133 are each considered to be primary blades. Each blade 131, 132, 133, in general terms of a primary blade, includes a body portion 134 that extends (longitudinally and radially projects) from the face 112 and is part of the bit body 111 (the bit body 111 is also known as the "frame" of the rotary drag bit 110). The body portion 134 may extend to the gage region 165 (FIG. 2). The body portion 134 includes a blade surface 135, a leading face 136 and a trailing face 137 and may extend radially outward from either a cone region 160 (FIG. 2) or an axial center line C/L (shown by numeral 161) of the rotary drag bit 110 toward a gage region 165. Fluid courses 120 are located between the portions of adjacent blades 131, 132, 133 that are located on the face 112 of the bit, and are continuous with junk slots 126 that are located between the portions of adjacent blades 131, 132, 133 that extend along the gage region 165 of the rotary drag bit 110. As the body portion 134 of the blades 131, 132, 133 radially extends outwardly from the axial center line 161 of the rotary drag bit 110, the blade surface 135 may radially widen, and the leading face 136 and the trailing face 137 may both axially protrude a greater distance from the face 112 of the bit body 111. While the illustrated embodiment of rotary drag bit 110 includes three blades 131, 132 and 133, a bit may have any number of blades, but generally will have no less than two blades separated by at least two fluid courses 120 and junk slots 126.

As drilling fluid emanates from ports 122, it is substantially transported by way of the fluid courses 120 to the junk slots 126 and onto the leading face 136 of the body portion 134 of each blade 131, 132, 133 during drilling. A portion of the drilling fluid will also wash across the blade surface 135, including the trailing face 137 of the blade surface 135, to cool and clean the cutters 114.

The rotary drag bit 110 in this embodiment of the invention includes three primary blades 131, 132, 133, but does not include any secondary or tertiary blades as are known in the art. A secondary blade or a tertiary blade provides additional support structure in order to increase the cutter density of the rotary drag bit 110 by receiving additional primary cutters 114 thereon. A secondary or a tertiary blade is defined much like a primary blade, but extends radially toward the gage region 165 generally from a nose region 162, a flank region 163 or a shoulder region 164 (FIG. 2) of the rotary drag bit 110. In this regard, a secondary blade or a tertiary blade is defined between leading and trailing fluid courses 120 in fluid communication with at least one of the ports 122. Also, a secondary blade or a tertiary blade, or a combination of secondary and tertiary blades, may be provided between primary blades. However, the presence of secondary or tertiary blades decreases the available volume of the adjacent fluid courses 120, providing less clearing action of the formation cuttings or cleaning of the cutters 114. Optionally, a rotary drag bit 110 in accordance with an embodiment of the invention may include one or more secondary or tertiary blades when needed or desired to implement particular drilling characteristics of the rotary drag bit.

In accordance with the first embodiment of the invention as shown in FIG. 1, the rotary drag bit 110 comprises three blades 131, 132, 133, three primary cutter rows 141, 142, 143 and three backup cutter groups 151, 152, 153, respectively. While three backup cutter groups 151, 152, 153 are included, it is contemplated that the rotary drag bit 110 may include one backup cutter group on one of the blades or a plurality of backup cutter groups on each blade greater or less than that illustrated. Further, it is contemplated that the rotary drag bit 110 may have more or fewer blades than the three illustrated. Each of the backup cutter groups 151, 152, 153 may have one or more backup cutter sets. For example, without limitation, the backup cutter group 152 includes three backup cutter sets 152', 152", 152'". A detailed description of backup cutter sets 152', 152", 152'" of the backup cutter group 152 is now provided.

Each primary cutter row 141, 142, 143 is arranged upon each blade 131, 132, 133, respectively. Rotationally trailing each of the primary cutter rows 141, 142, 143 on each of the blades 131, 132, 133 multiplies a backup cutter group 151, 152, 153, respectively. While each blade includes a primary cutter row rotationally followed by a backup cutter group in this embodiment, the rotary drag bit 110 may have a backup cutter group selectively placed behind a primary cutter row on at least one of the blades of the bit body 111. Further, the rotary drag bit 110 may have a backup cutter group selectively placed on multiple blades of the bit body 111.

Each of the backup cutter groups 151, 152, and 153 may have one or more backup cutter sets. For example, without limitation, the backup cutter group 152 includes three multiple backup cutter sets 152', 152", 152'". While backup cutter group 152 that is located on the same blade 132 and that rotationally trails the cutters of primary cutter row 142 includes three backup cutter sets 152', 152", 152'", it is contemplated that the rotary drag bit 110 may include one backup cutter set or a plurality of backup cutter sets in each backup cutter group greater or less than the three illustrated. The backup cutter sets 152', 152", 152'" of backup cutter group 152 of blade 132 will be discussed in further detail below as they are representative of the other multiple backup cutter sets in the other backup cutter groups 151, 153.

The backup cutter group 152, comprising the backup cutter sets 152', 152", 152'", comprises a first trailing cutter row 154, a second trailing cutter row 155, and a third trailing cutter row 156. Each of the rows 141, 142, 143, 154, 155, 156 includes one or more cutters 114 positionally coupled to the blades 131, 132, 133. A cutter row may be determined by a radial path extending from the centerline C/L (the centerline is extending out of FIG. 1 as indicated by numeral 161) of the face 112 of the rotary drag bit 110 and may be further defined by having one or more cutting elements or cutters disposed substantially along or proximate to the radial path.

With additional reference to FIG. 1, the primary cutter row 142 of blade 132 comprises cutters 3, 6, 11, 19, 28, 37, 46, 50. Each of the backup cutter sets 152', 152", 152'" respectively includes cutters 20, 29, 38 from the first trailing cutter row 154, cutters 21, 30, 39 from the second trailing cutter row 155, and cutters 57, 58, 59 from the third trailing cutter row 156. The first trailing cutter row 154 rotationally trails the primary cutter row 142 and rotationally leads the second trailing cutter row 155, which rotationally leads the third trailing cutter row 156. While each backup cutter set 152', 152", 152'" of this embodiment includes cutters 114 in trailing cutter rows 154, 155, 156, the number of cutter rows is only limited by the available area on the surface 135 of each blade 131, 132, 133. In this regard, the backup cutter set 152' includes three cutters 20, 21, 57 from three trailing cutter rows 154, 155, 156, respectively. While three cutters 20, 21, 57 are included in the backup cutter set 152', it is contemplated that each backup cutter set may include cutters from a plurality of trailing cutter rows.

The cutters 12, 20, 29, 38, 47 of the first trailing cutter row 154 rotationally trail the cutters 11, 19, 28, 37, 46 of the primary cutter row 142, respectively, and are considered to be backup cutters in this embodiment. Backup cutters rotationally follow a primary cutter in substantially the same rotational path, at substantially the same radius from the centerline C/L in order to increase the durability and life of the rotary drag bit 110 should a primary cutter fail or wear beyond its usefulness. However, the cutters 12, 20, 29, 38, 47 of the first trailing cutter row 154 may be any assortment or combination of primary, secondary and backup cutters. While the present embodiment does not include any secondary cutters, a secondary cutter may rotationally follow primary cutters in adjacent rotational paths, at varying radiuses from the centerline C/L in order to remove larger kerfs between primary cutters providing increased rate of penetration and durability of the rotary drag bit 110. Depending upon the cutter assortment, the cutters 12, 20, 29, 38, 47 may be spaced along their rotational paths at various radial positions in order to enhance cutter performance when engaging the material of a particular subterranean formation. Further, the cutters 12, 20, 29, 38, 47, rotationally trailing the cutters 11, 19, 28, 37, 46, are underexposed with respect to the cutters 11, 19, 28, 37, 46. Specifically, the cutters 12, 20, 29, 38, 47 are underexposed by twenty-five thousandths (0.025) of an inch (0.635 millimeters).

The cutters 21, 30, 39 of the second trailing cutter row 155 each rotationally trail the cutters 19, 28, 37 of the primary cutter row 142, respectively, and are also considered to be backup cutters to the primary cutter row 142 in this embodiment. Optionally, the cutters 21, 30, 39 may be backup cutters to the cutters 20, 29, 38 of the first trailing cutter row 154 or a combination of the first trailing cutter row 154 and the primary cutter row 142. While the cutters 21, 30, 39 are backup cutters, the cutters 21, 30, 39 of the second trailing cutter row 155 may be any assortment or combination of primary, secondary and backup cutters. Further, the cutters 21, 30, 39, rotationally trailing the cutters 19, 28, 37, are underexposed with respect to the cutters 19, 28, 37. Specifically, the cutters 21, 30, 39 are underexposed relative to the primary cutter row 142 by fifty thousandths (0.050) of an inch (1.27 millimeters).

The cutters 57, 58, 59 of the third trailing cutter row 156 each rotationally trail the cutters 19, 28, 37 of the primary cutter row 142, respectively, and are also backup cutters to the primary cutter row 142 in this embodiment. Optionally, the cutters 57, 58, 59 may be backup cutters to the cutters 21, 30, 39 of the second trailing cutter row 155 or a combination of the second trailing cutter row 155, the first trailing cutter row 154 and the primary cutter row 142. While the cutters 57, 58, 59 are backup cutters, the cutters 57, 58, 59 of the third trailing cutter row 156 may be any assortment or combination of primary, secondary and backup cutters. Further, the cutters 57, 58, 59, rotationally trailing the cutters 19, 28, 37, are under exposed with respect to the cutters 19, 28, 37. Specifically, the cutters 57, 58, 59 are under exposed by seventy-five thousandths of an inch (0.075) (1.905 millimeters).

Optionally, in embodiments of the invention to be further described below, each of the cutters 12, 20, 29, 38, 47, 21, 30, 39, 57, 58, 59 may have different underexposures or little to no underexposure with respect the cutters 114 of the primary cutter row 142 irrespective of each of the other cutters 12, 20, 29, 38, 47, 21, 30, 39, 57, 58, 59.

The cutters 114 of the first trailing cutter row 154, the second trailing cutter row 155 and the third trailing cutter row 156 are smaller than the cutters 114 of the primary cutter rows 141, 142, 143. The smaller cutters 114 of the cutter rows 154, 155, 156 are able to provide backup support for the primary cutter rows 141, 142, 143 when needed, but also provide reduced rotational contact resistance with the material of a formation when the cutters 114 are not needed. While the smaller cutters 114 of the first trailing cutter row 154, the second trailing cutter row 155 and the third trailing cutter row 156 are all the same size, it is contemplated that each cutter size may be greater or smaller than that illustrated. Also, while the cutters 114 of each cutter row 154, 155, 156 are all the same size, it is contemplated that the cutter size of each cutter row may be greater or smaller than the other cutter rows.

In an embodiment of the invention, one or more additional cutter rows may be included on a blade of a rotary drag bit rotationally following and in further addition to a primary cutter row and a backup cutter row. The one or more additional cutter rows in this aspect of the invention are not a second cutter row, a third cutter row or an nth cutter row located on subsequent blades of the drag bit. Each of the one or more additional backup cutter rows, the backup cutter row and the primary cutter row include one or more cutting elements or cutters on the same blade. Each of the cutters of the one or more additional backup cutter rows may align or substantially align in a concentrically rotational path with the cutters of the row that rotationally leads it. Optionally, each cutter may radially follow slightly off-center from the rotational path of the cutters located in the backup cutter row and the primary cutter row.

In embodiments of the invention, each one or more cutters of an additional cutter row may have a specific exposure with respect to one or more cutters of a preceding cutter row on a blade of a drag bit. For example, an exposure of one or more cutters of each cutter row may incrementally step-down in values from an exposure of one or more cutters of a preceding cutter row. In this respect, each of the one or more cutters of the cutter row may be progressively underexposed with respect to cutters of a rotationally preceding cutter row.

Optionally, one or more cutters of each subsequent cutter row may have an underexposure to a greater or lesser extent from one or more cutters of the cutter row preceding it. By adjusting the amount of underexposure for the cutters of the cutter rows, the cutters of the backup cutter rows may be engineered to come into contact with the material of the formation as the wearflat area of the primary cutters increases. In this respect, the cutters of the backup cutter rows are designed to engage the formation as the primary cutters wear in order to increase the life of the drag bit. Generally, a primary cutter is located typically toward or on the front or leading face 136 of the blade 131 to provide the majority of the cutting work load, particularly when the cutters are less worn. As the primary cutters of the drag bit are subjected to dynamic dysfunctional energy or as the cutters wear, the backup cutters in the backup cutter rows begin to engage the formation and begin to take on or share the work from the primary cutters in order to better remove the material of the formation.

Figure 3A:
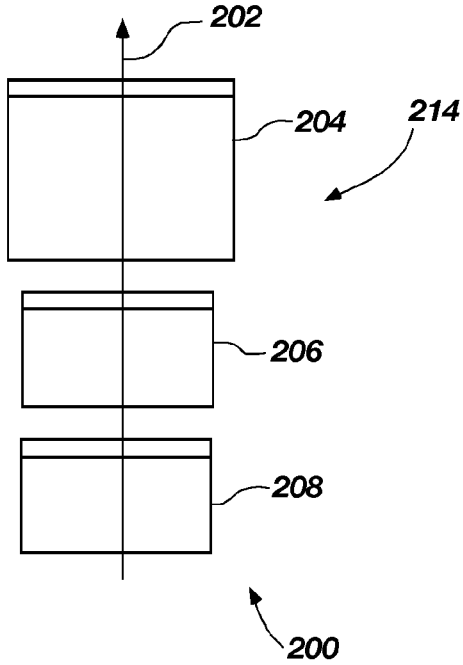
FIG. 3A shows a top view representation of an inline cutter set.

In accordance with embodiments of the invention, FIG. 3A shows a top view representation of an inline cutter set 200. FIG. 3A is a linear representation of a rotational or helical path 202 in which cutters 214 may be oriented upon a rotary drag bit. The inline cutter set 200 includes a primary cutter 204, a first backup cutter 206 and a second backup cutter 208, each cutter rotationally inline with the immediately preceding cutter, i.e., following substantially along the same rotational path 202. The larger primary cutter 204 and smaller backup cutters 206, 208 provide increased durability and provide longer life to a rotary drag bit. Further, the backup cutters 206, 208 each provide backup support for the primary cutter 204 should it fail or be subject to unexpectedly high dysfunction energy. Also, the backup cutters 206 and 208 each provide redundant backup support for the primary cutter 204 as it wears. In this regard, backup cutters 206, 208 are a backup cutter set.

Figure 3B:
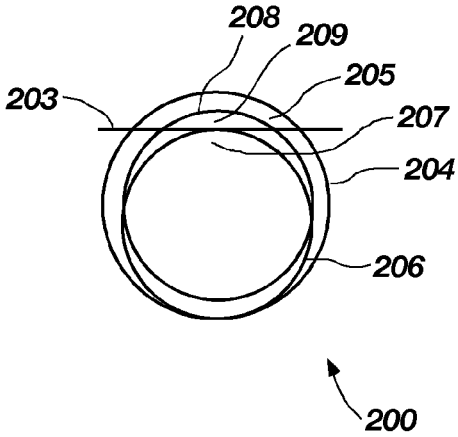
FIG. 3B shows a face view representation of the inline cutter set.

FIG. 3B shows a face view representation of the inline cutter set 200. The inline cutter set 200 comprises a fully exposed cutter face 205 for the primary cutter 204 and partially exposed cutter faces 207, 209 for the backup cutters 206, 208, respectively, relative to reference line 203. In this regard, the backup cutters 206, 208 are underexposed with respect to the primary cutter 204. The reference line 203 is also indicative of the amount of wear required upon the primary cutter 204 before the backup cutters 206, 208 come into progressive engagement taking on a substantial amount of work load when cutting the material of a formation. The inline cutter set 200 may be utilized with other embodiments of the invention. Further, the inline cutter set 200 may include a third backup cutter or a plurality of backup cutters in subsequent trailing rows of the cutter set. While the faces 205, 207, 209 include their respective exposures, the faces of the inline cutter set 200 may be configured to comprise the same exposure (or underexposures) or a combination of exposures for the cutters 204, 206, 208. Optionally, while the backup cutter 206, 208 are radially aligned with respect to the rotational path of the primary cutter 204, either, of which may be radially offset to a greater or lesser radial extent from the other cutters.

Figure 4A:
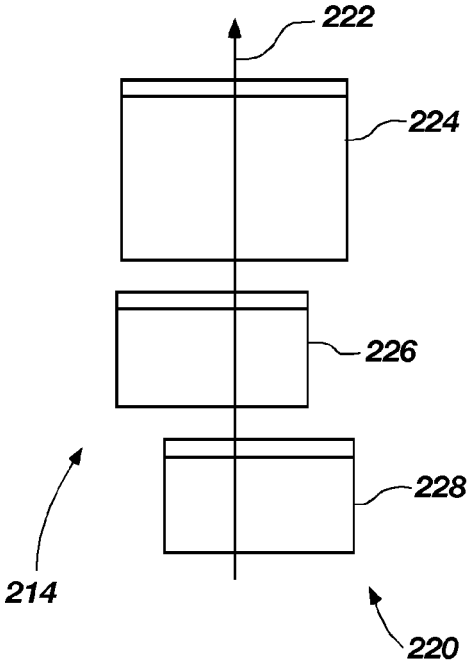
FIG. 4A shows a top view representation of a staggered cutter set.

In accordance with embodiments of the invention, FIG. 4A shows a top view representation of a somewhat staggered cutter set 220. FIG. 4A is a linear representation of a rotational or helical path 222 in which cutters 214 may be oriented upon a rotary drag bit. The staggered cutter set 220 includes a primary cutter 224, a first backup cutter 226 and a second backup cutter 228, each cutter radially staggered or offset from the other cutters 214 in a given rotational path. The first backup cutter 226 and second backup cutter 228 are smaller cutter sizes from the primary cutter 224. For example, the backup cutters 226, 228 have different, overlapping rotational paths, both of which lie primarily within the rotational path 222 of the primary cutter 224. The larger primary cutter 224 and the smaller backup cutters 226, 228 provide increased durability and provide longer life to a rotary drag bit. Further, the backup cutters 226, 228 each provide backup support for the primary cutter 224 should it fail or be subject to unexpectedly high dysfunction energy. Also, the backup cutters 226 and 228 each provide redundant backup support for the primary cutter 224 as it wears. In this regard backup cutters 226, 228 are a backup cutter set.

Figure 4B:
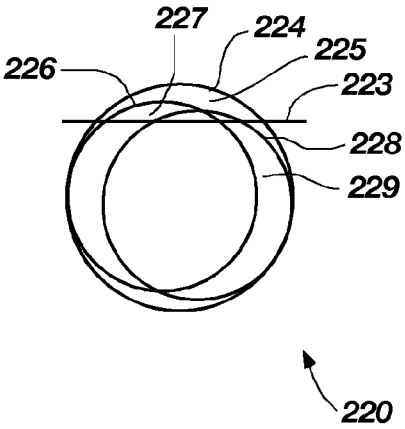
FIG. 4B shows a face view representation of the staggered cutter set.

FIG. 4B shows a face view representation of the staggered cutter set 220. The staggered cutter set 220 is shown having a fully exposed cutter face 225 for the primary cutter 224 and partially exposed cutter faces 227, 229 for the backup cutters 226, 228, respectively, relative to reference line 223. In this regard, the backup cutters 226, 228 are also underexposed with respect to the primary cutter 224. The reference line 223 is also indicative of the amount of wear required upon the primary cutter 224 before the backup cutters 226, 228 begin to substantially share work load from the primary cutter 224 when cutting the material of a formation. Advantageously with the staggered cutter set 220, as the primary cutter 224 wears, the staggered cutter set 220 provides two sharper cutters 226, 228 staggered about the radial path of the primary cutter 224 for more aggressive cutting than if the cutters were inline. The staggered cutter set 220 may be utilized with any embodiment of the invention. Further, the staggered cutter set 220 may include a third backup cutter or a plurality of backup cutters in subsequent trailing rows of the cutter set. While the faces 225, 227, 229 include their respective exposures, the faces of the staggered cutter set 220 may be configured to comprise the same exposure (or underexposures) or a combination of exposures as shown in FIG. 4B for the cutter 224, 226, 228.

In accordance with embodiments of the invention, a cutter set may include a plurality of cutters 214 having at least one cutter radially staggered or offset from the other cutters 214 and at least one cutter rotationally inline with a preceding cutter.

Figure 5:
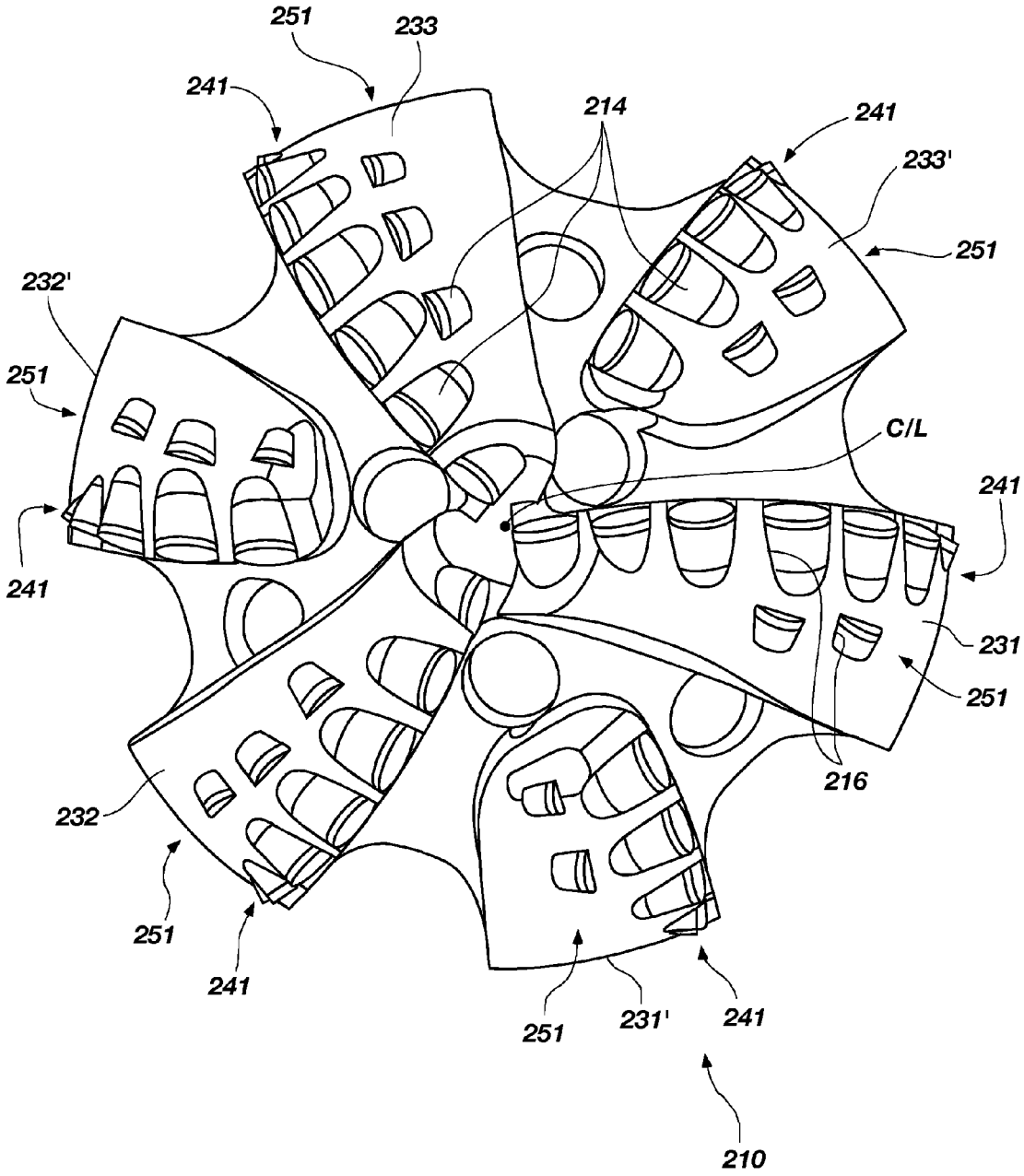
FIG. 5 shows a frontal view of a rotary drag bit in accordance with a second embodiment of the invention.

FIG. 5 shows a frontal view of a rotary drag bit 210 in accordance with a second embodiment of the invention. The rotary drag bit 210 comprises six blades 231, 231', 232, 232', 233, 233', each having a primary or first cutter row 241 and a second cutter row 251 extending from the center line C/L of the rotary drag bit 210. The cutter rows 241, 251 include cutters 214 coupled to cutter pockets 216 of the blades 231, 231', 232, 232', 233, 233'. It is contemplated that each blade 231, 231', 232, 232', 233, 233' may have more or fewer cutter rows 241, 251 than the two that are illustrated. Also, each of the cutter rows 241, 251 may have fewer or greater numbers of cutters 214 than illustrated on each of the blades 231, 231', 232, 232', 233, 233'. In this embodiment, blades 231, 232, 233 are primary blades and blades 231', 232', 233' are secondary blades. The secondary blades 231', 232', 233' provide support for adding additional cutters 214, particularly, in the nose region 262 (see FIG. 6) where the work requirement or potential for impact damage may be greater upon the cutters 214. The cutters 214 of the second cutter rows 251 provide backup support for the respective cutters 214 of the first cutter rows 241, respectively, should the cutters 214 become damaged or worn.

In order to improve the life of the rotary drag bit 210, each of the cutters 214 of the second cutter rows 251 may be oriented inline, offset, underexposed, or staggered, or a combination thereof, for example, without limitation, relative to each of their respective cutters 214 of the first cutter row 241. In this regard, a cutter 214 of a second cutter row 251 may assist and support a cutter 214 of the first cutter row 241 by removing material from the formation should the cutter 214 of the first cutter row 214 fail. In this embodiment of the invention, the second cutter rows 251 include cutters 214 that are inline, offset, staggered, and/or underexposed on each of the blades 231, 231', 232, 232', 233, 233'. Discussion of the second cutter rows 251 of the blades 231, 231', 232, 232', 233, 233' will now be taken in turn.

Figure 6:
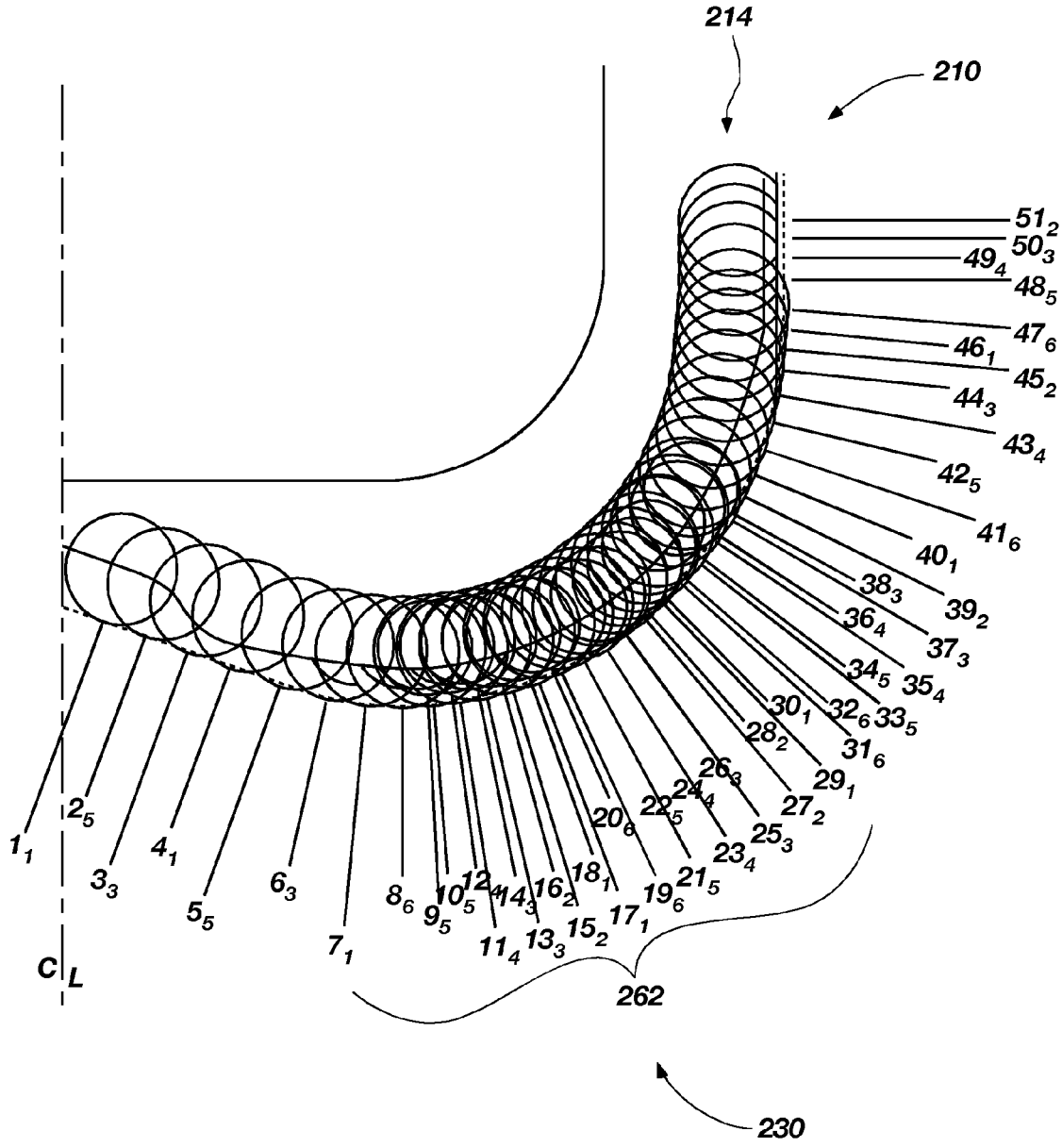
FIG. 6 shows a cutter and blade profile for the second embodiment of the invention.

FIG. 6 shows a cutter and blade profile 230 for the embodiment of the rotary drag bit 210 depicted in FIG. 5. The rotary drag bit 210 has a cutter density of 51 cutters and a profile as represented by cutter and blade profile 230. The cutters 214 are numbered 1 through 51. The cutters 1-51, while they may include aspects of other embodiments of the invention, should not be confused with the numbered cutters of the other embodiments of the invention. Specific cutter profiles for each of the blades 231, 231', 232, 232', 233, 233' are shown in FIGS. 7 through 12, respectively.

Figure 7:
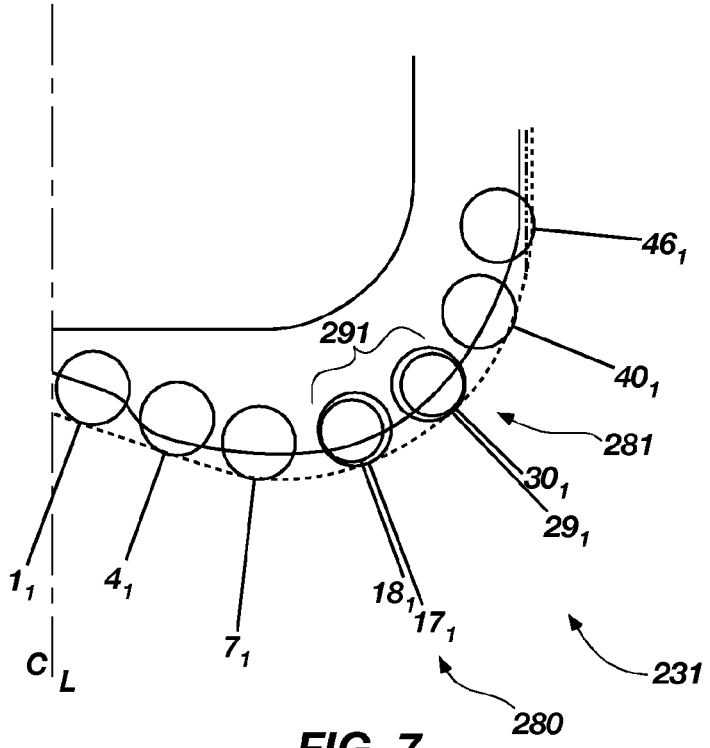
FIG. 7 shows a cutter profile for a first blade of the rotary drag bit of FIG. 5.

As shown in FIG. 7, the blade 231 carries a second cutter row 251 and a first cutter row 241. The first cutter row 241 includes primary cutters 17 and 29. The second cutter row 251 includes backup cutters 18 and 30. Cutter 18 is staggered relative to and rotationally trails primary cutter 17, while cutter 30 is staggered relative to and rotationally trails primary cutter 29. The cutters 17 and 18 form a staggered cutter set 280. Likewise, the cutters 29 and 30 also form a staggered cutter set 281. Staggered cutters 18 and 30 form a staggered cutter row 291. While the staggered cutters 18, 30 have multi-exposure or offset underexposures relative to their respective primary cutters 17, 29, they may have the same or uniform underexposure compared to primary cutters 17 and 29, respectively.

Figure 8:
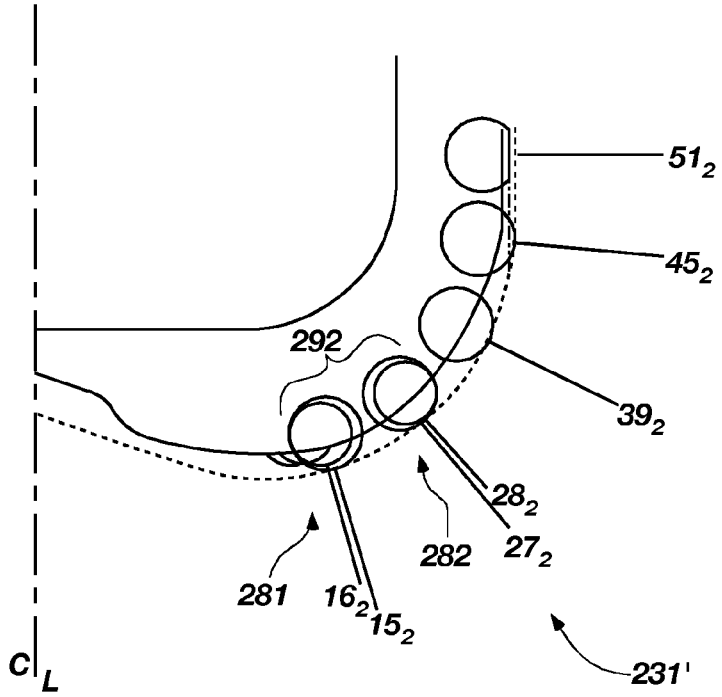
FIG. 8 shows a cutter profile for a second blade of the rotary drag bit of FIG. 5.

FIG. 8 shows blade 231', which caries a second cutter row 251 and a first cutter row 241. The first cutter row 241 includes primary cutters 15 and 27. The second cutter row 241 includes backup cutters 16 and 28. Cutter 16 is staggered relative to and rotationally trails primary cutter 15, while cutter 28 is staggered relative to and rotationally trails primary cutter 27. The cutters 15 and 16 form a staggered cutter set 281. Likewise, the cutters 27 and 28 also form a staggered cutter set 281. Staggered cutters 16 and 28 form a staggered cutter row 292. While the staggered cutters 16, 28 have multi-exposure or offset underexposures relative to their respective primary cutters 15, 27, they may have the same or uniform underexposure compared to prima cutters 15 and 27, respectively.

Figure 9:
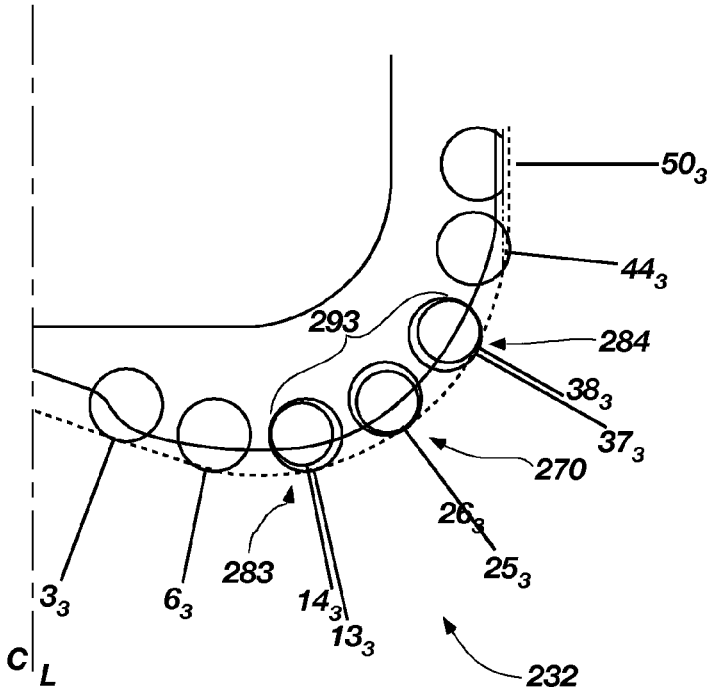
FIG. 9 shows a cutter profile for a third blade of the rotary drag bit of FIG. 5.

FIG. 9 shows blade 232, which carries a second cutter row 251 and a first cutter row 241. The first cutter row 241 includes primary cutters 13, 25 and 37. The second cutter row 241 includes backup cutters 14, 26 and 38. Cutter 14 is staggered relative to and rotationally trails primary cutter 13, and cutter 38 is staggered relative to and rotationally trails primary cutter 37, while cutter 26 is inline relative to and rotationally trails primary cutter 25. The cutters 13 and 14, and 37 and 38 form two staggered cutter sets 283, 284, respectively. The cutters 25 and 27 form an inline cutter set 270. While the inline cutter 26 and the staggered cutters 14, 38 have multi-exposure or offset underexposures relative to their respective primary cutters 13, 25, and 37, they may have the same or uniform underexposure compared to primary cutters 13, 25, and 37, respectively.

Figure 10:
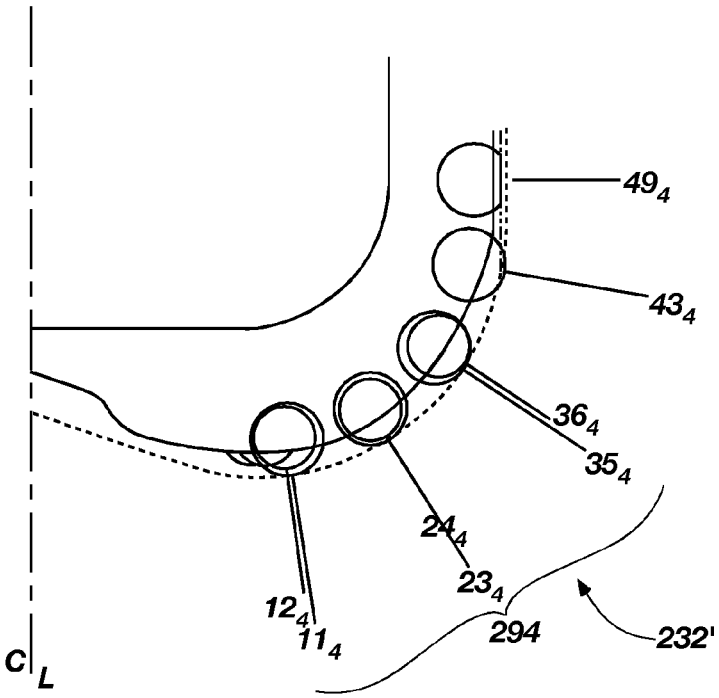
FIG. 10 shows a cutter profile for a fourth blade of the rotary drag bit of FIG. 5.
Figure 11:
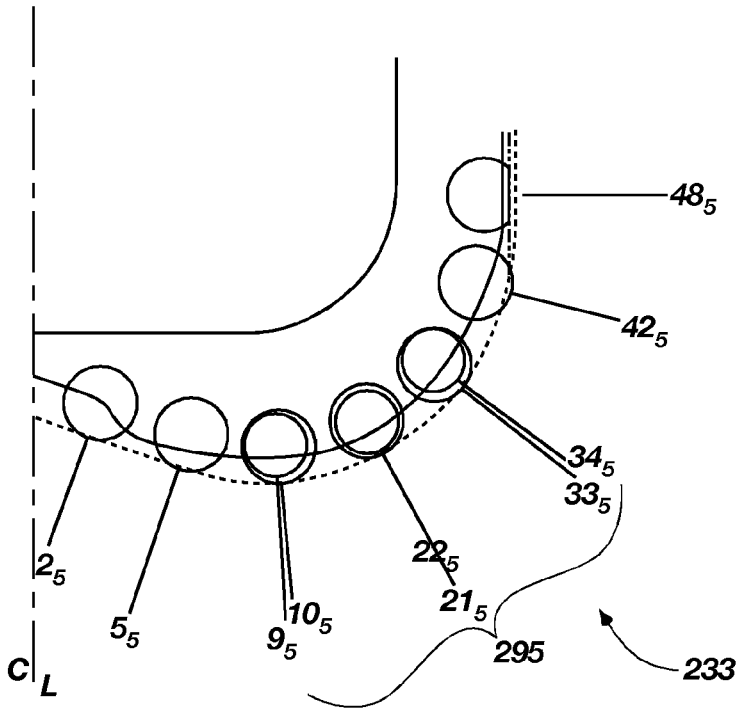
FIG. 11 shows a cutter profile for a fifth blade of the rotary drag bit of FIG. 5.
Figure 12:
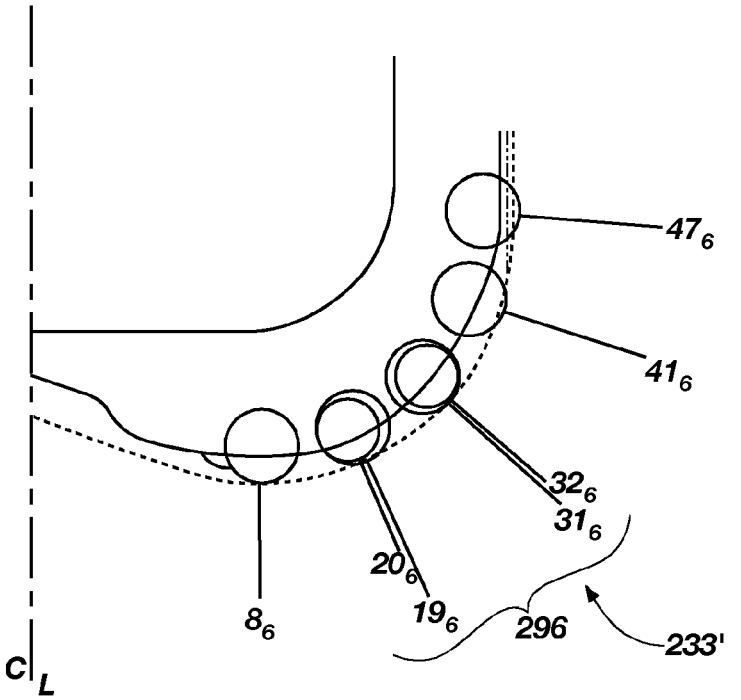
FIG. 12 shows a cutter profile for a sixth blade of the rotary drag bit of FIG. 5.

Similarly, FIG. 10 shows blade 232' having a second cutter row 251 comprising staggered cutters 12, 36 and an inline cutter 24 forming a staggered cutter row 294. Also, a second cutter row 251 of blade 233 shown in FIG. 11 comprises staggered cutters 9, 34 and an inline cutter 22 forming a staggered cutter row 295. Further, a second cutter row 251 of blade 233' as shown in FIG. 12 comprises staggered cutters 20, 32 forming a staggered cutter row 296. While various arrangements of staggered cutters and in-line cutters are arranged in the rows 251 of blades 231, 231', 232, 232', 233, 233' of the rotary drag bit 210 as illustrated in FIGS. 7-12, it is contemplated that one or more staggered cutters may be provided with or without the inline cutters illustrated in second cutter rows 251 of the blades 231, 231', 232, 232', 233, 233'.

In accordance with embodiments of the invention, a plurality of staggered cutters may have uniform underexposure or may be uniformly staggered with respect to their respective primary cutters. In this regard, the staggered cutters may have substantially the same underexposure or amount of offset, i.e., staggering, with respect to their corresponding primary cutters as each of the underexposure and staggering of the other staggered cutters. Also, it is contemplated that one or more staggered cutter rows may be provided beyond the second cutter row 251 illustrated, the one or more staggered cutter rows may include cutters staggered non-uniformly distributed and having different underexposures with respect to other staggered cutters within the same cutter row. Further contemplated, the second cutter row 251 may include cutters 214 having underexposures distributed non-linearly within a staggered cutter row, the cutters 214 being distributed with respect to the staggered cutter row extending radially outward from the centerline C/L of the rotary drag bit 210.

Figure 13:
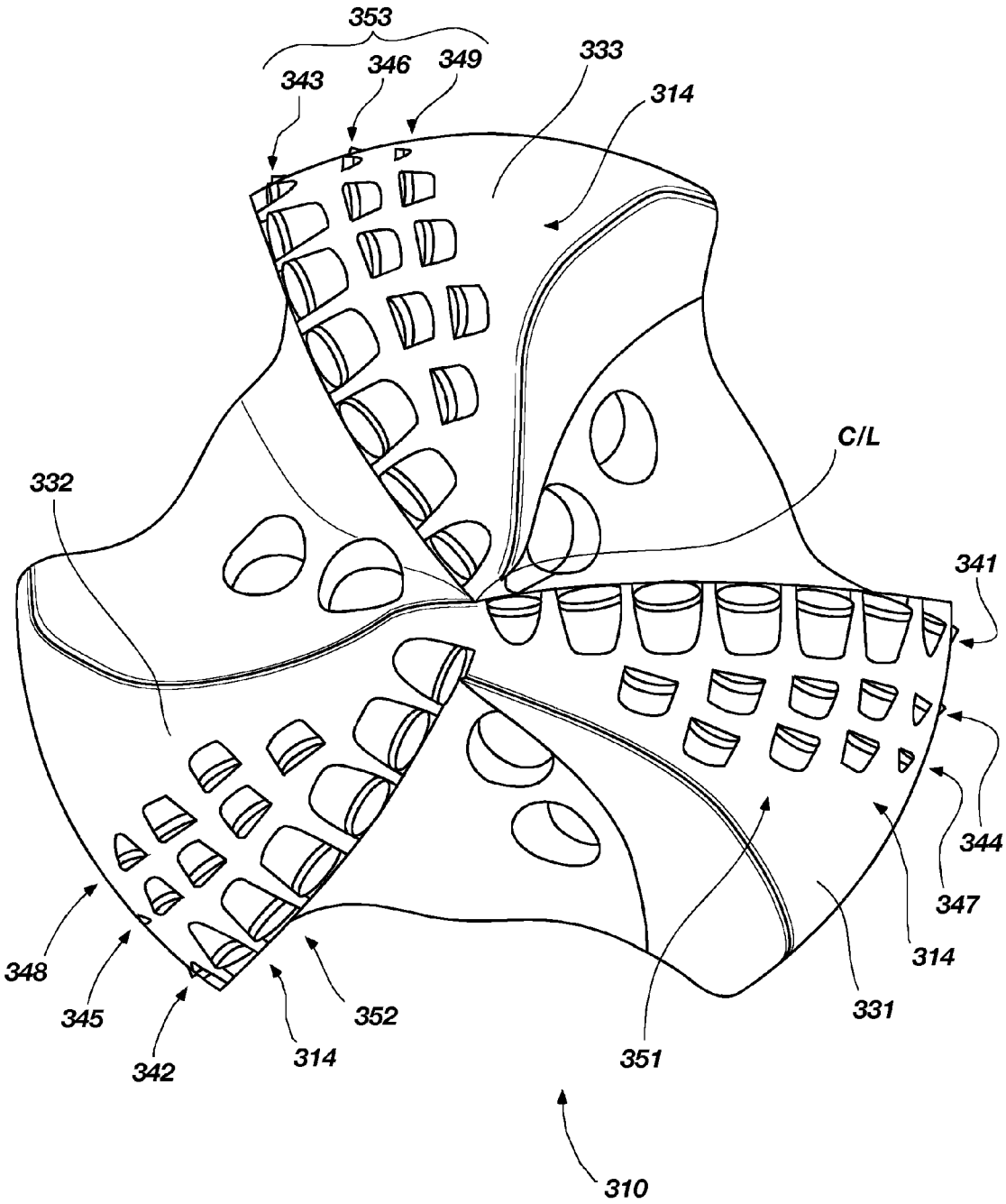
FIG. 13 a frontal view of a rotary drag bit in accordance with a third embodiment of the invention.

FIG. 13 shows a frontal view of another embodiment of a rotary drag bit 310. The rotary drag bit 310 comprises three primary blades 331, 332, 333 each comprising a primary or first cutter row 341, 342, 343, a backup or second cutter row 344, 345, 346, and an additional backup or third cutter row 347, 348, 349, respectively, extending radially outward from the center line C/L of the bit 310. Optionally, one or more additional backup cutter rows may be provided upon at least one of the blades 331, 332, 333 beyond the first cutter rows 341, 342, 343 and the second cutter rows 344, 345, 346 illustrated. Each cutter row 341, 342, 343, 344, 345, 346, 347, 348, 349 includes a plurality of cutters 314; each cutter 314 coupled to a cutter pocket 316 of the blades 331, 332, 333.

Figure 14:
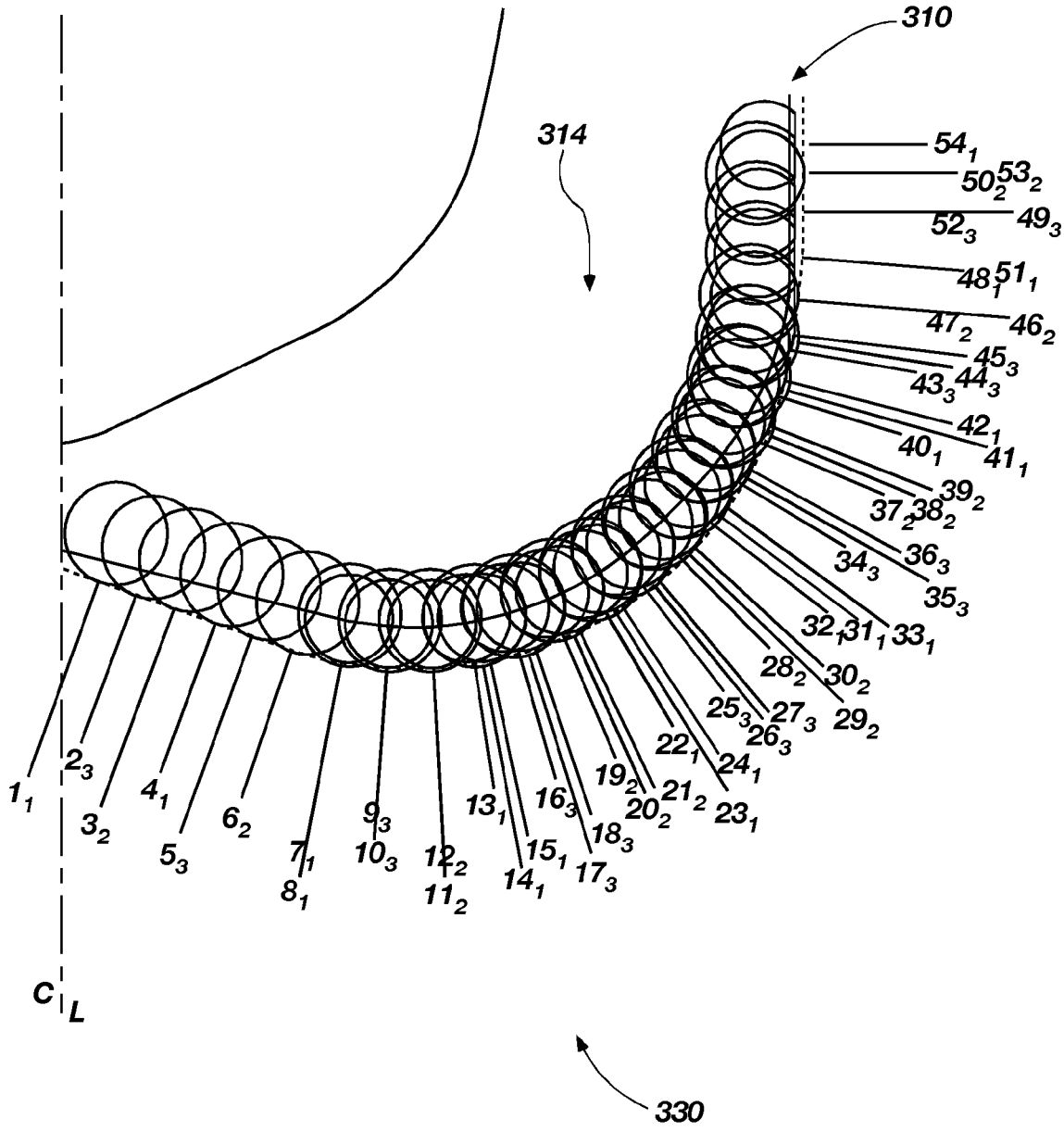
FIG. 14 shows a cutter and blade profile for the third embodiment of the invention.

The cutters 314 in cutter rows 341, 342, 343 are fully exposed cutters as shown in FIG. 14, which provides a cutter and blade profile 330 for bit 310. The drag bit 310 has a cutter density of 54 cutters and a profile as represented by cutter and blade profile 330. The cutters 314 are numbered 1 through 54. While the cutters 1-54 may incorporate aspects of other embodiments of the invention, they are not to be confused with the numbered cutters of the other embodiments of the invention. The cutters 314 in cutter rows 344, 345, 346 are underexposed by twenty-five thousandths (0.025) of an inch (0.635 millimeters) relative to the cutters in their rotationally leading cutter rows 341, 342, 343. The cutters 314 in cutter rows 347, 348, 349 are underexposed by fifty thousandths (0.050) of an inch (1.27 millimeters) relative to the cutters in their rotationally leading cutter rows 341, 342, 343. In this aspect, the cutter rows 341, 344, 347 form a cutter group 351 for the blade 331. While the cutters 314 of cutter rows 344, 347 are underexposed by twenty-five thousandths (0.025) of an inch (0.635 millimeters) and fifty thousandths (0.050) of an inch (1.27 millimeters), respectively, with respect to the cutters of cutter row 341, it is contemplated that each cutter row may be underexposed by a lesser, equal or greater extent than presented. Cutter rows 342, 345, 348 form a cutter group 352 for the blade 332, and the cutter rows 343, 346, 349 form a multi-layer cutter group 353 for the blade 333. While each of the multi-layer cutter groups 351, 352, 353 include cutter rows having cutters with the same underexposure relative to cutters of the leading row of each group, it is contemplated that they may include cutter rows with cutters having a greater or lesser extent of underexposure relative to cutters of their corresponding leading row.

Figure 15:
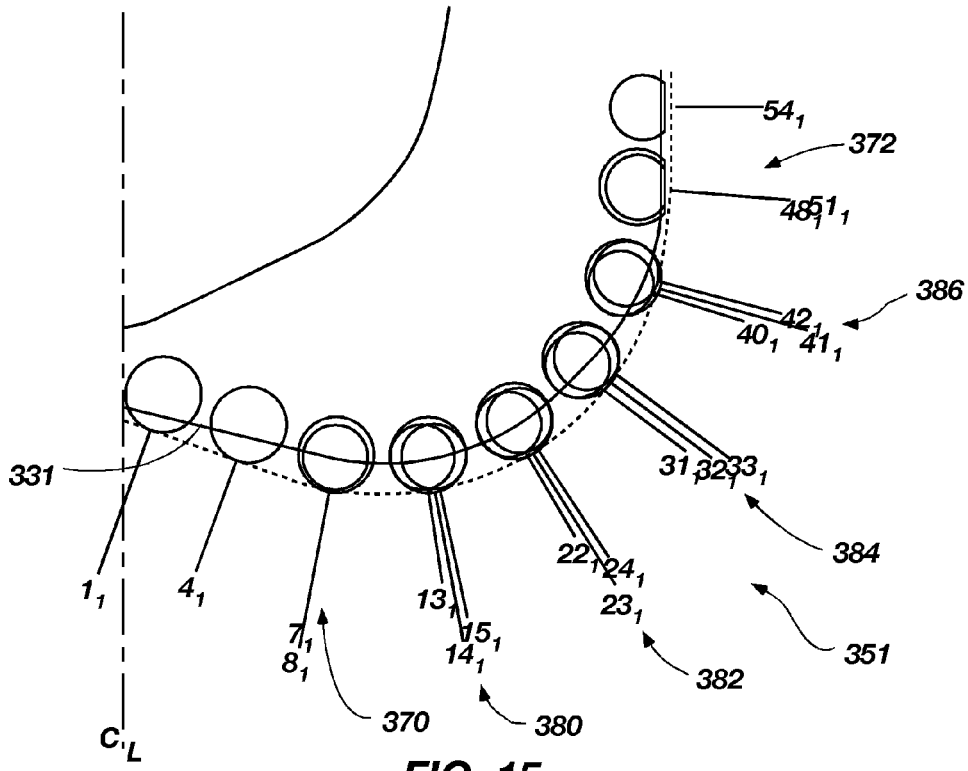
FIG. 15 shows a cutter profile for a first blade of the rotary drag bit of FIG. 13.
Figure 16:
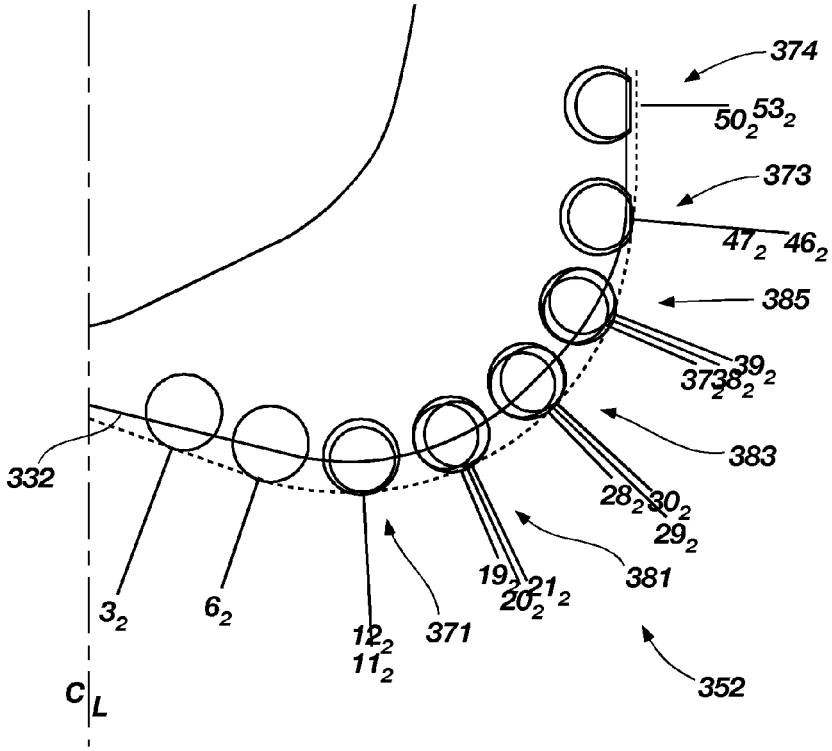
FIG. 16 shows a cutter profile for a second blade of the rotary drag bit of FIG. 13.
Figure 17:
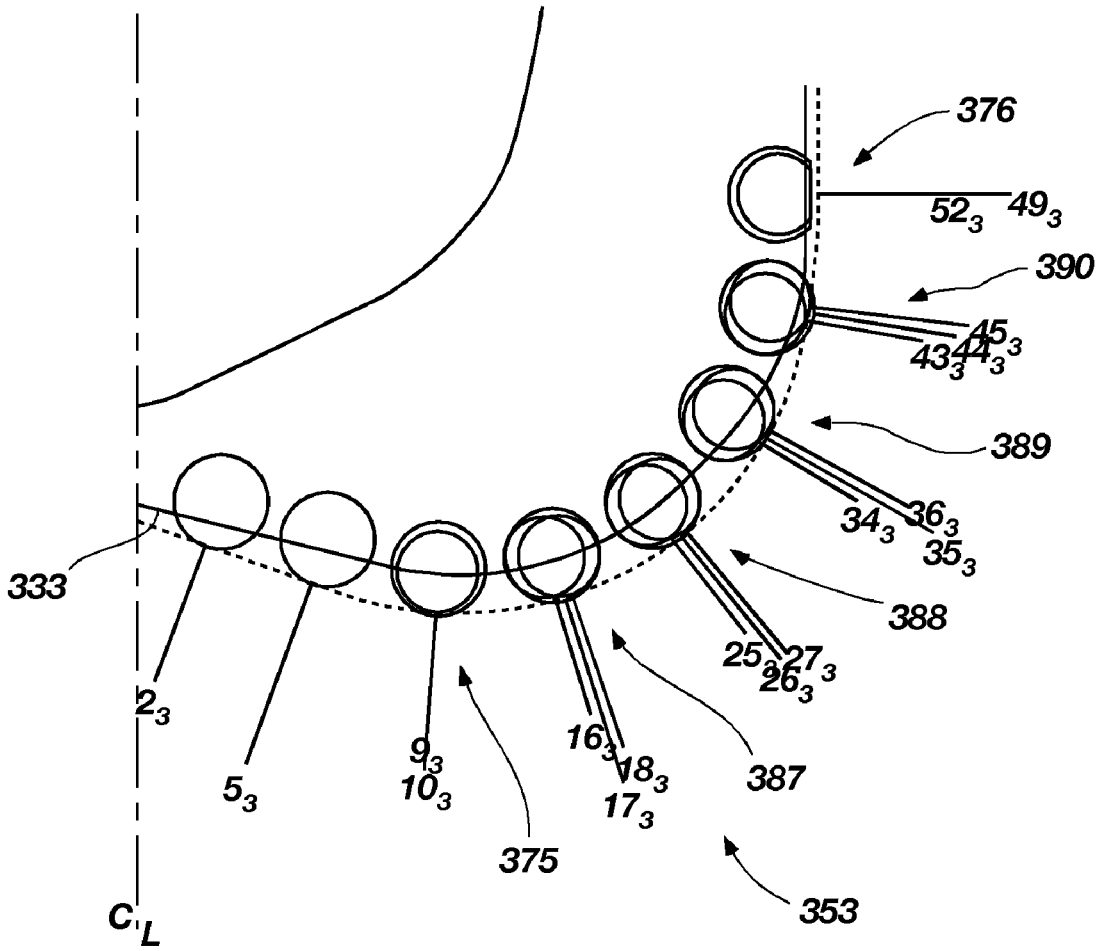
FIG. 17 shows a cutter profile for a third blade of the rotary drag bit of FIG. 13.

Specific cutter profiles for each of the blades 331, 332, 333 are shown in FIGS. 15 through 17, respectively. For blade 331, the first cutter row 341 of the cutter group 351 includes cutters 1, 4, 7, 14, 23, 32, 41, 48 having a cutter diameter of ⅝ inch (about 16 millimeters) and includes cutter 54 having a cutter diameter of ½ inch (about 13 millimeters). Generally, the cutters 314 of the first cutter row 341 exhibit cutters sized larger than the cutters 314 of the second cutter row 344 and the third cutter row 347. The second cutter row 344 of the cutter group 351 includes cutters 8, 15, 24, 33, 42, 51 having a cutter diameter of ½ inch (about 13 millimeters). The third cutter row 347 of the cutter group 351 includes cutters 13, 22, 31, 40 having a cutter diameter of ½ inch (about 13 millimeters). The cutter group 351 provides enhanced durability and life to the drag bit 310 by providing improved contact engagement with a formation over the life of the cutters 314. The cutter group 351 has improved performance when cutting a formation by providing the smaller cutters 314 in the second and third cutter rows 344, 345 which improve the performance of the larger cutters 314 of the first cutter row 341. In this regard, for example, the smaller cutters 13, 15 rotationally follow the larger cutter 14 in a rotational path providing less interference or resistance upon the formation while removing material than would be conventionally obtained with a single secondary row of cutters having the same cutter size with a primary row of cutters. While the cutters 314 have ½ inch (about 13 millimeters) and ⅝ inch (about 16 millimeters) cutter diameters, the cutters 314 may have any larger or smaller cutter diameter than illustrated.

The cutters 314 are inclined, i.e., have a backrake angle, at 15 degrees backset from the normal direction with respect to the rotational path each cutter travels in the drag bit 310 as would be understood by a person having ordinary skill in the art. It is anticipated that each of the cutters 314 may have more or less aggressive backrake angles for particular applications different from the 15 degree backrake angle illustrated.

As shown in FIG. 15, the cutter group 351 of blade 331 includes two inline cutter sets 370, 372 and four staggered cutter sets 380, 382, 384, 386. In this embodiment, the inline cutter sets 370, 372, comprising cutters 7, 8 and cutters 48, 51, respectively, provide backup support and extend the life of the primary cutters 7 and 48. Also, the staggered cutter sets 380, 382, 384, 386 improve the ability to remove formation material while providing backup support for their respective primary cutters of those sets and extend the life the drag bit 310.

The cutter group 352 of blade 332 comprises three inline cutter sets 371, 373, 374 and three staggered cutter sets 381, 383, 385 as shown in FIG. 16.

As shown in FIG. 17, the cutter group 353 of blade 333 comprises two inline cutter sets 375, 376 and four staggered cutter sets 387, 388, 389, 390.

In embodiments of the invention, a drag bit may include one or more cutter groups to improve the life and performance of the bit. Specifically, a multi-layer cutter group may be included on one or more blades of a bit body, and further include one or more multi-exposure cutter rows, one or more staggered cutter sets, or one or more inline cutter sets, in any combination without limitation.

In embodiments of the invention, a multi-layer cutter group may include cutter sets or cutter rows having different cutter sizes in order to improve, by reducing, the resistance experienced by a rotary drag bit when a backup cutter follows a primary cutter. In this regard, a smaller backup cutter is better suited for following a primary cutter that is larger in diameter in order to provide a smooth concentric motion as a drag bit rotates. In one aspect, by decreasing the diameter size of each backup cutter from a ⅝ inch (about 16 millimeters) cutter diameter of the primary cutter to ½ inch (about 13 millimeters), 11 millimeters, or ⅜ inch (about 9 millimeters), for example, without limitation, there is less interfering contact with the formation while removing material in a rotational path created by primary cutters. In another aspect, by providing backup cutters with smaller cutter size, there is decreased formation contact with the non-cutting surfaces of the backup cutters, which improves the ROP of the rotary drag bit.

In embodiments of the invention, a cutter of a backup cutter row may have a backrake angle that is more or less aggressive than a backrake angle of a cutter on a primary cutter row. Conventionally, in order to maintain the durability of a primary cutter a less aggressive backrake angle is utilized; while giving up cutter performance, the less aggressive backrake angle made the primary cutter more durable and less likely to chip when subjected to dysfunctional energy or string bounce. By providing backup cutters in embodiments of the invention, a more aggressive backrake angle may be utilized on the backup cutters, the primary cutters or on both. The combined primary and backup cutters provide improved durability allowing the backrake angle to be aggressively selected in order to improve the overall performance of the cutters with less wear or chip potential caused by vibrational effects when drilling.

In embodiments of the invention, a cutter of a backup cutter row may have a chamfer that is more or less aggressive than a chamfer of a cutter on a primary cutter row. Conventionally, in order to maintain the durability of a primary cutter a longer chamfer was utilized, particularly when a more aggressive backrake angle was used on a primary cutter. While giving up cutter performance, the longer chamfer made the primary cutter more durable and less likely to fracture when subjected to dysfunctional energy while cutting. By providing backup cutters, a more aggressive, i.e., shorter, chamfer may be utilized on the backup cutters, the primary cutters or on both in order to increase the cutting rate of the bit. The combined cutters provide improved durability allowing the chamfer lengths to be more or less aggressive in order to improve the overall performance of the cutters with less fracture potential also caused by vibrational effects when drilling.

Figure 18:
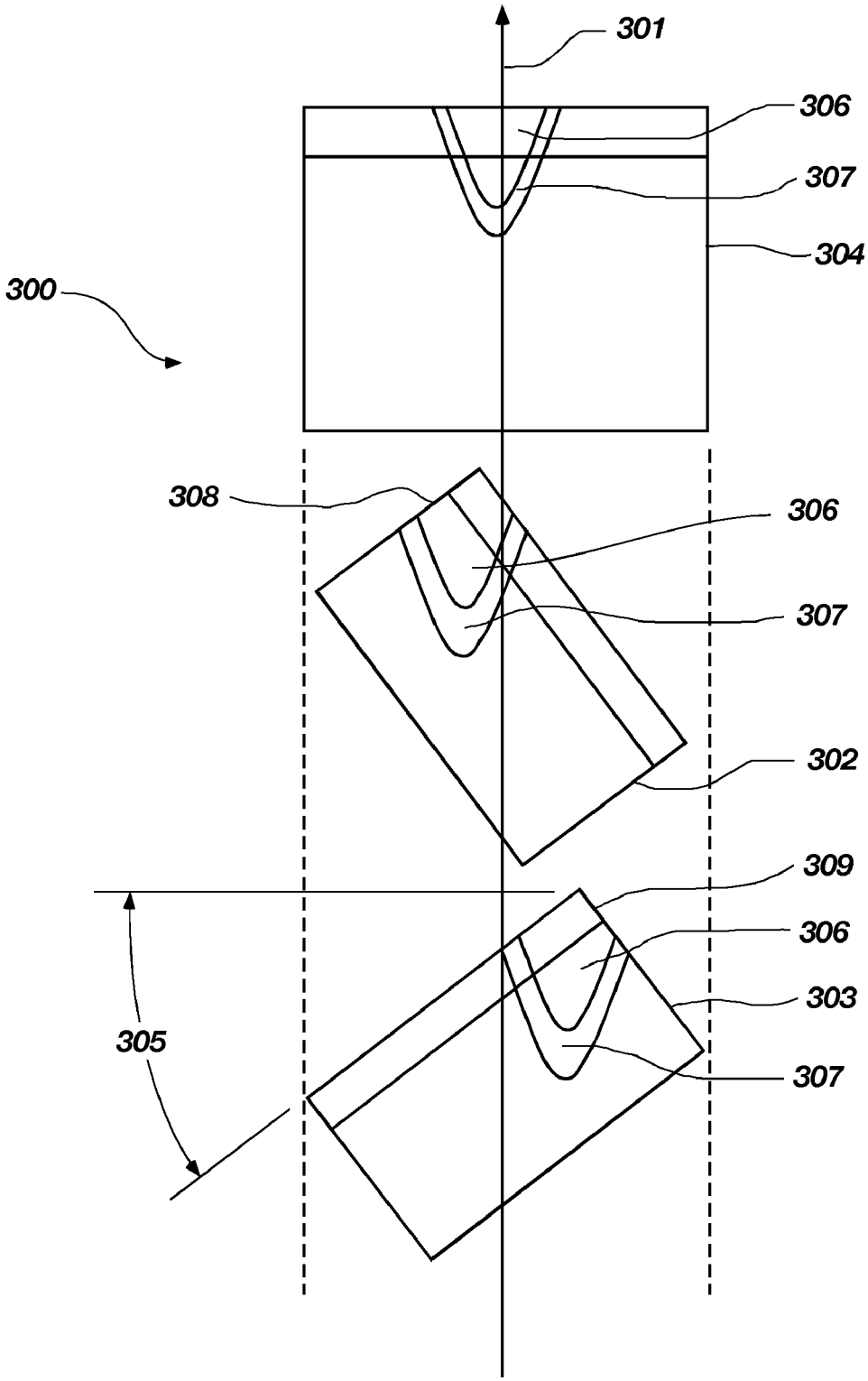
FIG. 18 shows a top view representation of an inline cutter set having two sideraked cutters.

In embodiments of the invention, a drag bit may include a backup cutter coupled to a cutter pocket of a blade, the cutter having a siderake angle with respect to the rotational path of the cutter. In one example, FIG. 18 shows a top view representation of a drag bit having an inline cutter set 300 with two sideraked cutters 302, 303. FIG. 18 is a linear representation of a rotational or helical path 301 in which the inline cutter set 300 may be oriented upon a rotary drag bit. The inline cutter set 300 includes a primary cutter 304 and two sideraked cutters 302, 303. The sideraked cutter 303 rotationally follows and is smaller than the primary cutter 304, and is oriented at a siderake angle 305. The sideraked cutter 302 is also oriented at a siderake angle in the opposite direction from the siderake angle 305, as illustrated. While two sideraked cutters 302, 303 are provided in the inline cutter set 300, it is contemplated that one or more additional sideraked cutters (i.e., the two illustrated) may be provided. While wearflats 306, 307 may develop upon the primary cutter 304 as it wears, by orienting the sideraked cutters 302, 303, at sideraked angles, the sideraked cutters 302, 303 may maintain sharper edges 308, 309 improving the ROP of the bit. Also, as the wearflats 306, 307 upon the primary cutter 304 grow, the sharper edges 308, 309 of the sideraked cutters 302 and 303 may increase the stress that the cutters 302, 303 are able to apply upon the formation in order to fracture and remove material therefrom. While the cutter set 300 is shown here having zero backrake angle or "rake," it is contemplated that the cutters 302, 303, 304 may also be oriented at backrake angles as would be understood by a person having ordinary skill in the art. While the sideraked cutter 303 is included with an inline cutter set 300, it is also contemplated that the sideraked cutter may be utilized in a backup cutter set, a backup cutter group, a cutter row, a staggered cutter row, and a staggered cutter set, for example, without limitation.

In embodiments of the invention, a cutting structure may be coupled to a blade of a drag bit, providing a larger diameter primary cutter placed at a front of the blade followed by one or more rows of smaller diameter cutters either in substantially the same helical path or some other variation of cutter rotational tracking. The smaller diameter cutters, which rotationally follow the primary cutter, may be underexposed to different levels related to depth-of-cut or wear characteristics of the primary cutter so that the smaller cutters may engage the material of the formation at a specific depth of cut or after some worn state is achieved on the primary cutter. Depth-of-cut control features as described in U.S. Pat. No. 7,096,978 entitled "Drill bits with reduced exposure of cutters," the disclosure of which is incorporated herein by this reference, may be utilized in embodiments of the invention.

Figure 19:
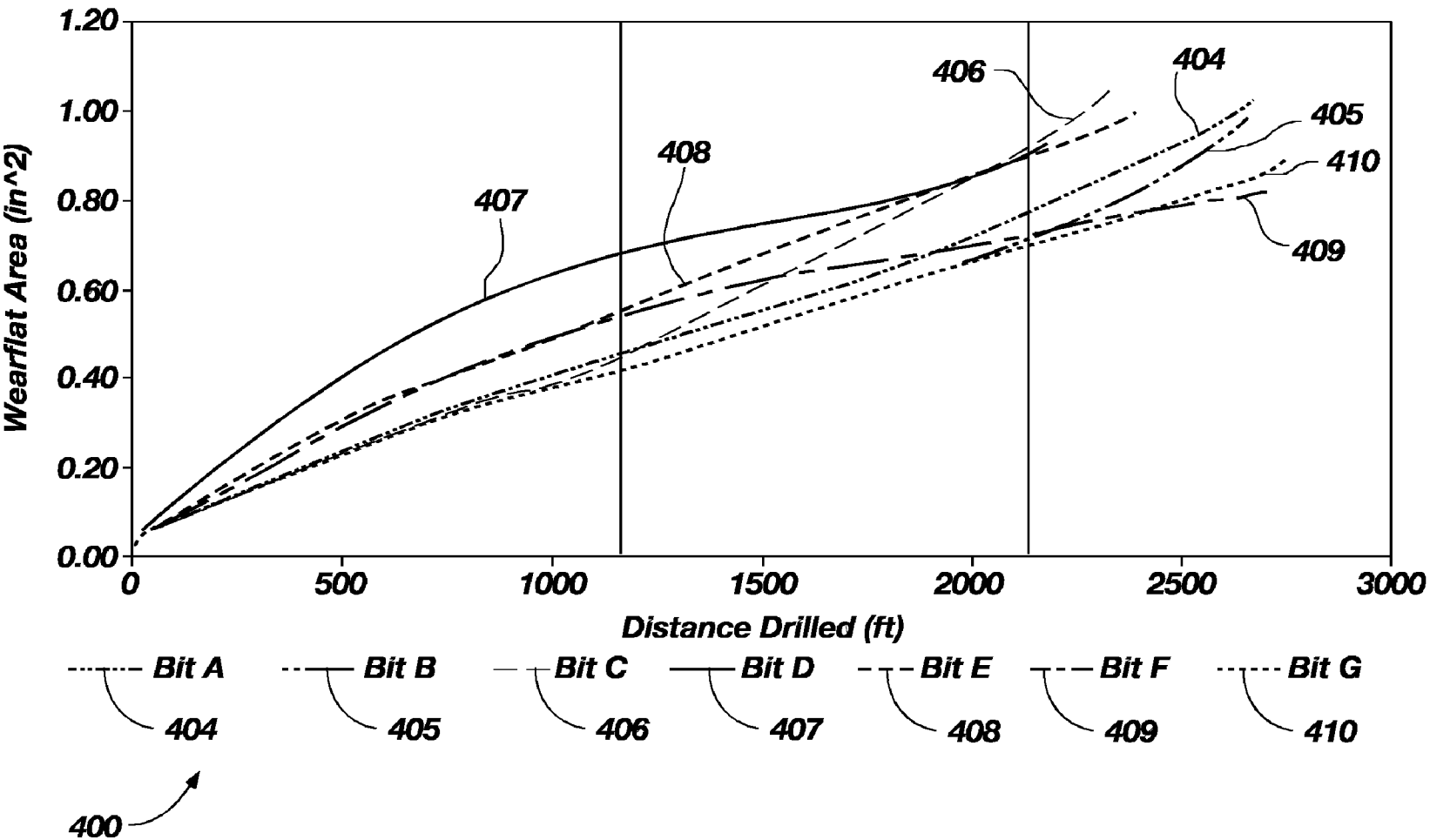
FIG. 19 is a graph of cumulative diamond wearflat area during simulated drilling conditions for seven different drag bits over distance drilled.
Figure 20:
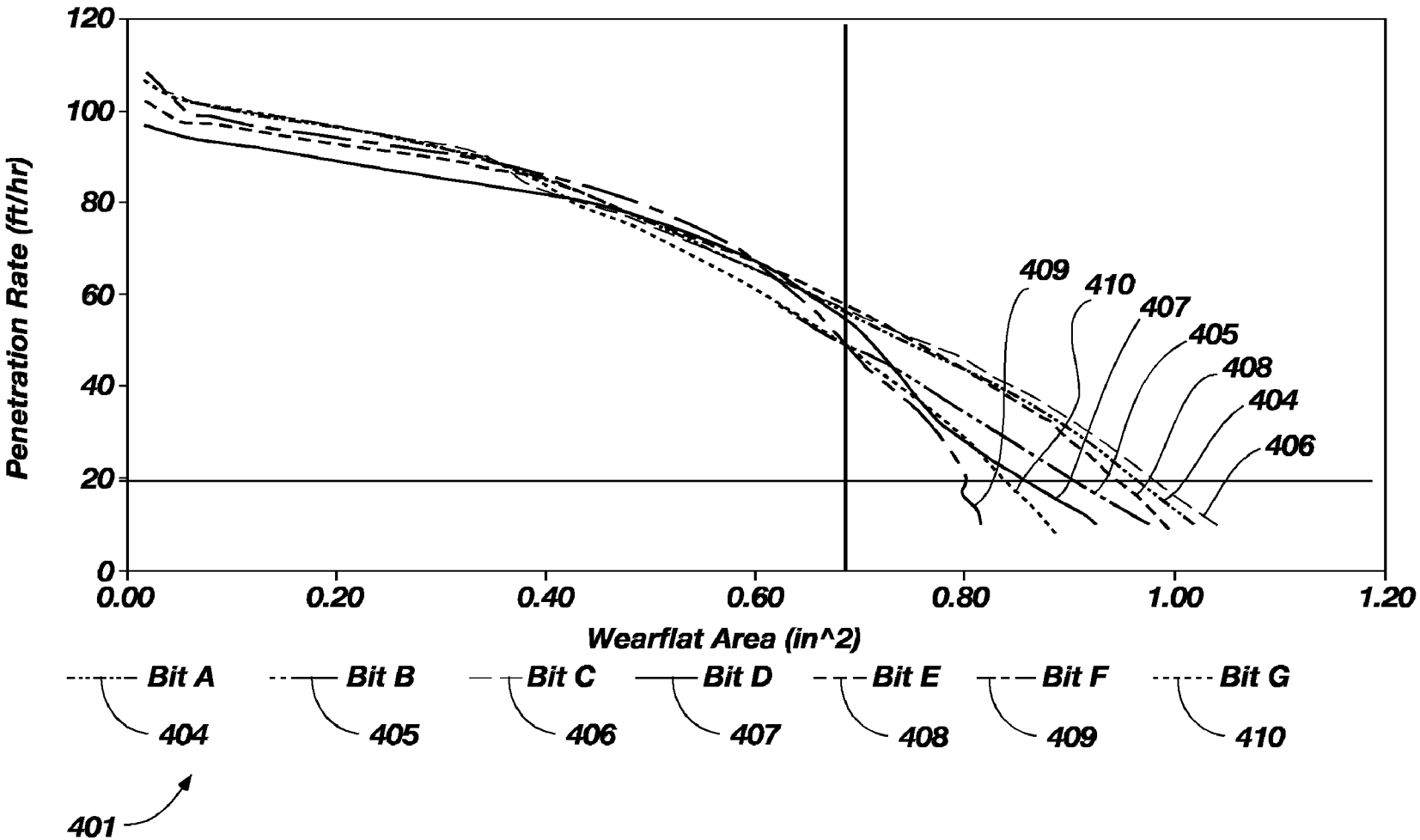
FIG. 20 is a graph of drilling penetration rate of the simulated drilling conditions of FIG. 19.
Figure 21:
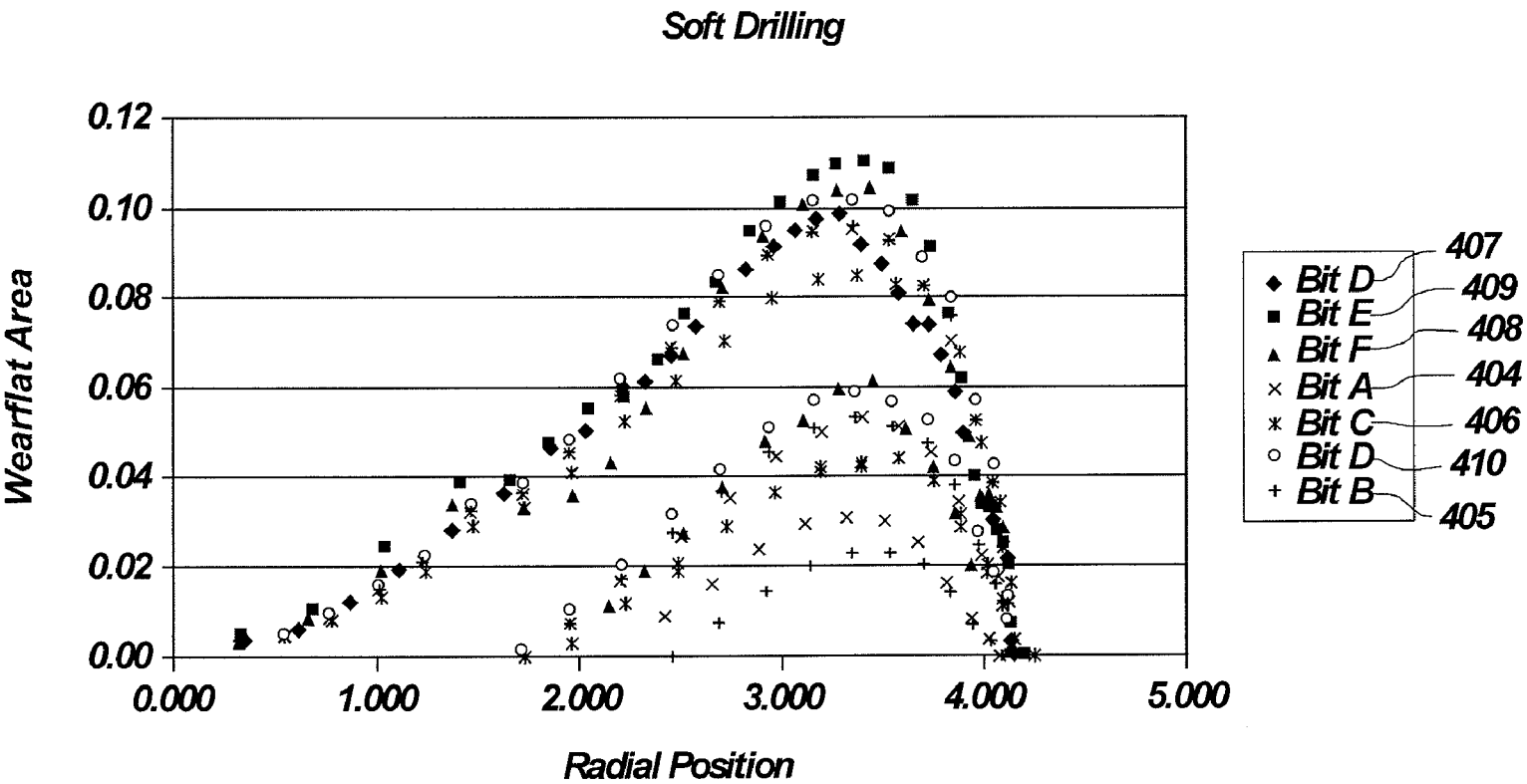
FIG. 21 is a graph of wearflat area for each cutter as a function of cutter radial position for the simulated drilling conditions of FIG. 19 at the end of the simulation.

In FIGS. 19, 20 and 21, the performance of several drag bits 404, 405, 406 according to different embodiments of the invention are compared to the performance of conventional drag bits 407, 408, 409, 410. Specifically, the FIGS. 19, 20 and 21 each show the accumulated cutter wearflat area over the life of the drag bits 404, 405, 406, 407, 408, 409, 410, as predicted by using software modeling. Advantageously, the rotary drag bits 404, 405, 406, utilizing embodiments of the invention have improved wearflat versus ROP characteristics that extends the life of the cutting elements or cutters for faster rates of penetration while accumulating less wear upon the primary cutters as compared to the conventional drag bits 407, 408, 409, 410 in order to improve overall drilling performance. Improved drilling performance may be qualified to mean drilling further faster without giving up durability of a drag bit. In FIGS. 19, 20 and 21, the results, as portrayed, are identified by reference to the numeral given to each of the drag bits 404, 405, 406, 407, 408, 409, 410.

The rotary drag bit 404 comprises three blades and three rows of cutters on each blade. The first row of cutters is a primary row of cutters rotationally followed by two staggered cutter rows, in which the cutters of the first staggered cutter row are underexposed by twenty-five thousandths (0.025) of an inch (0.635 millimeters) and the cutters of the second staggered cutter row are underexposed by fifty thousandths (0.050) of an inch (1.27 millimeters).

The rotary drag bit 405 comprises three blades and three rows of cutters on each blade. The first row of cutters is a primary row of cutters rotationally followed by two inline cutter rows, in which the cutters of the first inline cutter row are underexposed by fifty thousandths (0.050) of an inch (1.27 millimeters) and the cutters of the second inline cutter row are underexposed by fifty thousandths (0.050) of an inch (1.27 millimeters).

The rotary drag bit 406 comprises three blades and three rows of cutters on each blade. The first row of cutters is a primary row of cutters rotationally followed by two inline cutter rows, in which the cutters of the first inline cutter row are underexposed by twenty-five thousandths (0.025) of an inch (0.635 millimeters) and the cutters of the second inline cutter row are underexposed by twenty-five thousandths (0.025) of an inch (0.635 millimeters).

Conventional drag bit 407 comprises six blades and a single row of primary cutters on each of the blades. Conventional drag bit 408 comprises four blades with a primary row of cutters and a backup row of cutters on each of the blades. Conventional drag bit 409 comprises five blades and a single row of primary cutters on each of the blades. Conventional drag bit 410 comprises three blades with a primary row of cutters and a backup row of cutters on each of the blades.

FIG. 19 is a graph 400 of cumulative diamond wearflat area during simulated drilling conditions for seven different drag bits 404, 405, 406, 407, 408, 409, 410. The graph 400 of FIG. 19 includes a vertical axis indicating total diamond wearflat area of all the cutting elements in square inches (by 645.16 in square millimeters), and a horizontal axis indicating distance drilled in feet (by 0.3048 in meters). FIG. 19 shows that the differences in the amount of wearflat area and the wearflat rate over the life of the bit are influenced by the layout and orientation of the cutters upon the drag bits 404, 405, 406, 407, 408, 409, 410. For example, within the first 1200 feet (366 meters) of drilling, the wearflat rate, i.e., slope of the curves, increases at a faster rate for conventional drag bits 407, 408, 409 particularly within the initial segment of formation drilling (i.e., the first 1200 feet (366 meters)), whereas the rotary drag bits 404, 405, 406 incorporating teachings of the present invention and conventional drag bit 410 maintained a lower wear rate. As the wearflat rate for drag bits 407, 409 begins to decrease as the wearflat area approaches the usable end for effective drilling, i.e., beyond 1200 feet (366 meters) as illustrated, the rate of penetration undesirably decreases at a significant rate over the remaining bit life. In this respect, after about 1200 feet (366 meters) of drilling, the wearflat rate begins to increase at a greater rate for the drag bits 404, 405, 406, 408, 410 having at least one backup cutter row. At about 2100 feet (640 meters) drilled, the wearflat rate of the rotary drag bit 405 with multiple backup rows of cutters begins to increase over the wearflat rate of the drag bit 410 having only one row of backup cutters, indicating that the bit 410 is nearing its usable life and its rate of penetration is significantly decreasing as is shown in FIG. 20. These changes in the wearflat rate for each of the drag bits 404, 405, 406, 407, 408, 409, 410 affect the desired ROP (as will be shown in FIG. 20) and, thus, the overall life of the bit, particularly when drilling faster further is the desired goal.

Comparing FIG. 19 and FIG. 20, it will be appreciated that, in order to maintain a faster ROP over a given distance of drilling, it may be desirable to increase and control the wearflat growth of the cutters slowly at first and allow for a greater rate increase over the remaining life of the bit. By providing one or more backup cutter rows on each blade of a drag bit having fewer blades, the wearflat rate of the cutters may provide for enhanced performance in terms of wear and ROP characteristics.

FIG. 20 is a graph 401 of drilling penetration rate of the simulated drilling conditions of FIG. 19. The graph 401 of FIG. 20 includes a vertical axis indicating penetration rate (or ROP) in feet per hour (by 0.3048 in meters per hour), and a horizontal axis indicating wearflat area in square inches (by 645.16 in square millimeters). The rotary drag bits 404, 405, 406 incorporating teachings of the present invention, and conventional drag bit 408, each having backup cutters, experience improved ROP at wearflat area greater than 0.7 square inches (452 square millimeters). Conventional drag bits 407, 409, 410 experience an accelerated decrease in ROP as the wearflat area increases beyond about 0.7 square inches (452 square millimeters). However, while the drag bit 408, with just the one backup cutter row, maintains a higher ROP as the cutters wear over its usable life, FIG. 19 shows that drag bit 408 cannot bore as deeply into a formation as any of rotary drag bits 404, 405, 406 incorporating teachings of the present invention. By designing a drag bit having a higher ROP over the usable life of the cutters, i.e., as the cutters wear, the drag bit can drill faster further. The cutters configured incorporating teachings of the present invention increase the durability of the bit so that the cutters are less susceptible to damage and further provide the cutting structure required to maintain higher ROP as the bit wears. In this regard, additional rows of cutters are believed to also provide improved wearflat area control for maintaining higher ROP.

FIG. 21 is a graph 402 of wearflat area for each cutter as a function of cutter radial position for the simulated drilling conditions of FIG. 19 at the end of the simulation, i.e., when the penetration rate fell below 10 feet (3.04 meters) per hour, as shown in FIG. 20. The graph 402 of FIG. 21 includes a vertical axis indicating diamond wearflat area of each cutting elements in square inches (by 645.16 in square millimeters), and a horizontal axis indicating the radial position of cutting element from the center of the drag bit in inches (by 25.4 in millimeters). The graph 402 indicates the worn state of each cutting element or cutter for each of the drag bits 404, 405, 406, 407, 408, 409, 410 at the end of the simulation. Of interest, the primary row of cutters for the inventive rotary drag bits 404, 405, 406 experienced less cutter wear when compared with the conventional drag bits 407, 408, 409, 410. In this regard, the wear of the cutters provides an indication of the work load carried by each cutter and ultimately an indication of the ROP for a particular drag bit as its cutters wear.

Figure 22:
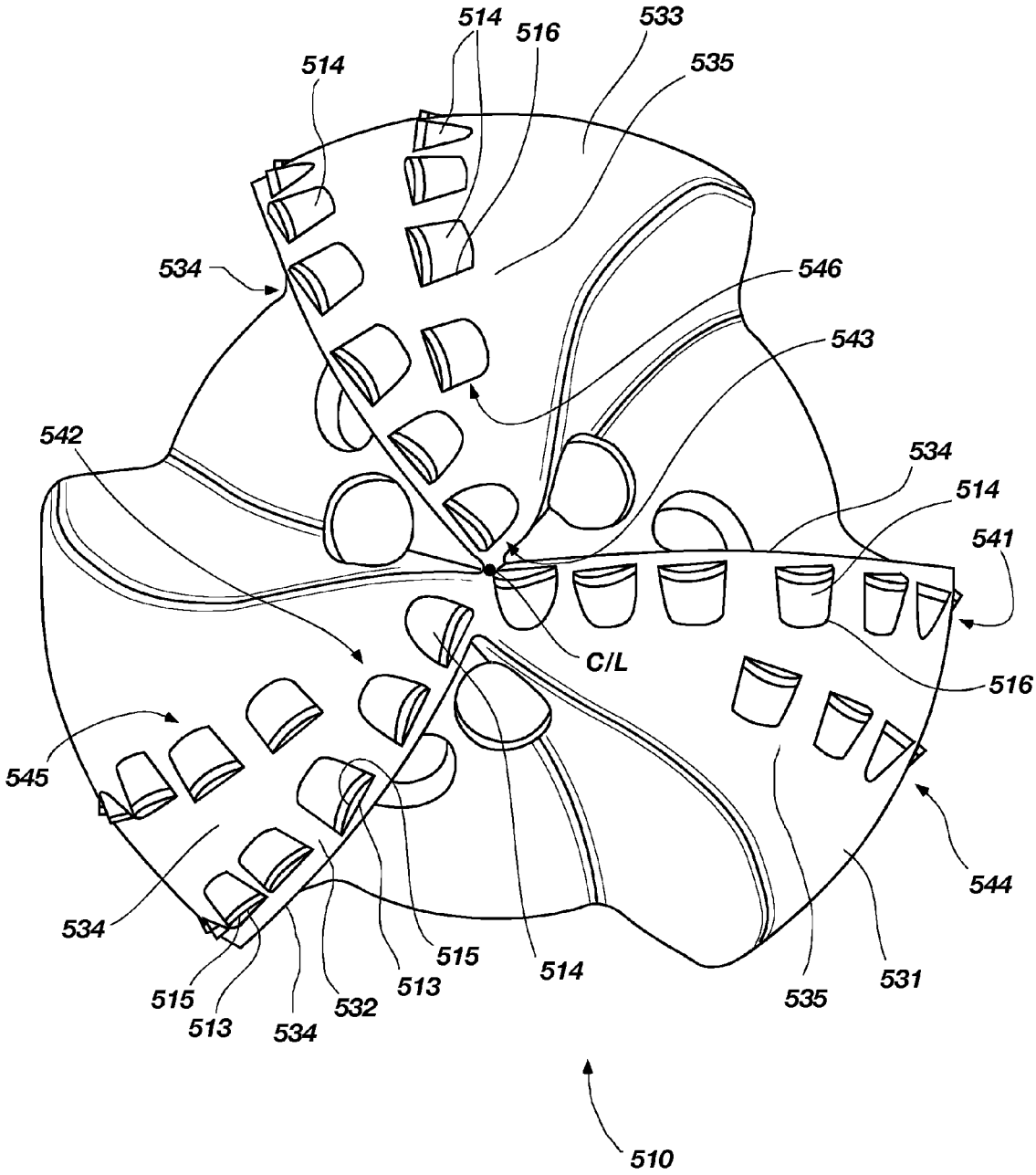
FIG. 22 shows a frontal view of a rotary drag bit in accordance with a fourth embodiment of the invention.

FIG. 22 shows a frontal view of a rotary drag bit 510 in accordance with another embodiment of the invention. The rotary drag bit 510 comprises three blades 531, 532, 533, each comprising a front or first cutter row 541, 542, 543, and a surface or second cutter row 544, 545, 546, respectively, extending radially outward from the center line C/L of the rotary drag bit 510. The cutter rows 541, 542, 543, 544, 545, 546 include a plurality of primary cutters 514 coupled to the drag bit 310 in cutter pockets 516 of the blades 531, 532, 533. The cutter rows 541, 542, 543, 544, 545, 546 allow primary cutters 514 to be selectively positioned on fewer blades than conventionally required to achieve a desired cutter profile. In this regard, the second cutter rows 544, 545, 546 provide primary cutters 514 in at least two distinct cutter rows upon a single blade, which allows for a reduction in the number of blades otherwise required on a conventional drag bit, providing improved durability of a higher bladed drag bit while achieving faster ROP of a lower bladed drag bit. Also, each of the three blades 531, 532, 533 may have fewer or more primary cutter rows beyond the second cutter rows 544, 545, 546, respectively, as illustrated.

Optionally, while the rotary drag bit 510 includes three blades 531, 532, 533, the rotary drag bit 510 may include one or more primary blades. Also, one or more additional or backup cutter rows may be provided that include secondary, backup or multiple backup cutters upon at least one of the blades 531, 532, 533 beyond the first cutter rows 541, 542, 543 and the second cutter rows 544, 545, 546, respectively, as illustrated. In this respect, the rotary drag bit 510 may incorporate aspects of other embodiments of the invention.

Figure 23:
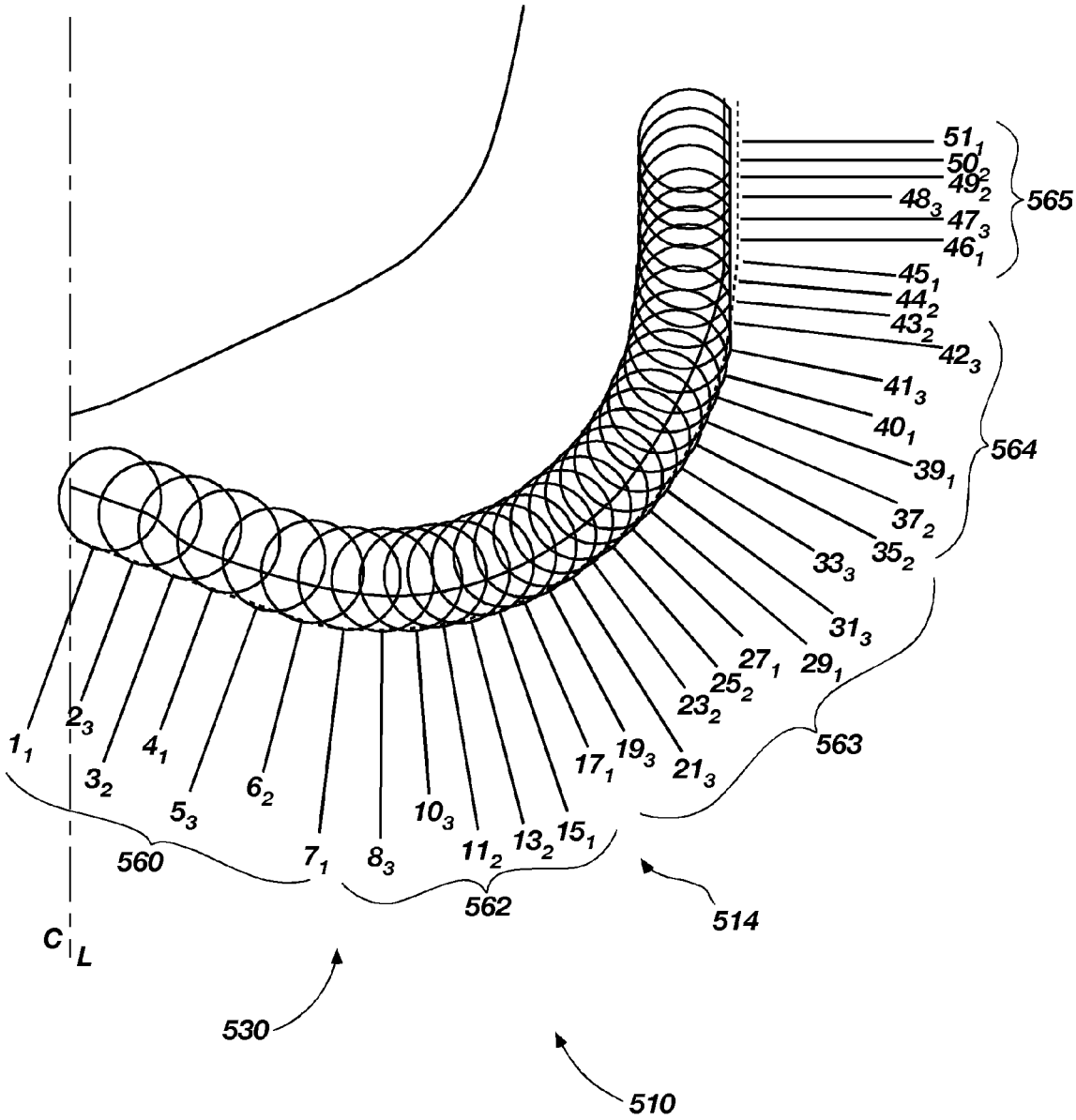
FIG. 23 shows a cutter and blade profile for the fourth embodiment of the invention.

The cutters 514 in cutter rows 541, 542, 543, 544, 545, 546 are fully exposed primary cutters as shown in FIG. 23, which shows a cutter and blade profile 530 for the fourth embodiment of the invention. The rotary drag bit 510 has a cutter density of 51 cutters and a profile as represented by cutter and blade profile 530. The cutters 514 are numbered 1 through 51. The cutters 1-51, while they may include aspects of other embodiments of the invention, are not to be confused with the numbered cutters of the other embodiments of the invention. The cutters 514 in cutter rows 544, 545, 546 are positioned in adjacent rotary paths and fully exposed with respect to the cutters 514 in cutter rows 541, 542, 543 allowing the cutters 514 to provide the diamond volume in certain radial locations on the drag bit in order to optimize formation material removal while controlling cutter wear. In this respect, cutters 1-51 provide the cutter profile conventionally encountered on a six-bladed drag bit, however the cutters 1-51 are able to remove more material from the formation at a faster rate because of their placement upon a drag bit with a lesser number of blades.

Each of cutters 514 is inclined, i.e., has a backrake angle ranging between about 15 and about 30 degrees backward rotation from the normal direction orientation of the surface of the cutting table of each cutter relative to a tangent where an edge of the table contacts the borehole surface with respect to the rotational path each cutter travels as would be understood by a person having ordinary skill in the art. It is contemplated that each of the cutters 514 may have more or less aggressive backrake angles for particular applications different from the backrake angle illustrated. In another aspect, it is also contemplated that the backrake angle for the cutters 514 coupled substantially on each blade surface 535 in the second cutter rows 544, 545, 546 may have more or less aggressive backrake angles relative to the cutters 514 of the first cutter rows 541, 542, 543 which are coupled substantially toward a leading face 534 and subjected to more dysfunctional energy during formation drilling.

A chamfer 515 is included on a cutting edge 513 of each of the cutters 514. The chamfer 515 for each cutter 514 may vary between a very shallow, almost imperceptible surface for a more aggressive cutting structure up to a depth of ten thousandths (0.010) of an inch (0.254 millimeters) or sixteen thousandths (0.016) of an inch (0.406 millimeters), or even deeper for a less aggressive cutting structure, as would be understood by a person having ordinary skill in the art. It is contemplated that each chamfer 515 may have more or less aggressive width for particular radial placement of each cutter 514, i.e., cutter placement in a cone region 560 a nose region 562, a flank region 563, a shoulder region 564 or a gage region 565 of the rotary drag bit 510. In another aspect, it is also contemplated that the chamfer 515 of each cutter 514 coupled substantially on each blade surface 535 in the second cutter rows 544, 545, 546 may have more or less aggressive chamfer widths relative to each cutter 514 of the first cutter rows 541, 542, 543 which are coupled substantially toward a leading face 534 and subjected to more dysfunctional energy during formation drilling.

Faster penetration rate, or ROP, is obtained when drilling a formation with the rotary drag bit 510. Conventional drag bits experience more wear upon cutters as the blade count decreases and the ROP increases. By providing the rotary drag bit 510 with the number of blades decreased from a conventional higher bladed bit such as six blades, to the three blades 531, 532, 533 illustrated, there is a performance increase in cutter wear and ROP. The lower blade count allows the blade surface 535 of each blade 531, 532, 533 to be widened, which provides space for increasing the cutter density or volume upon each blade, i.e., achieving an equivalent cutter density of a six bladed drag bit upon a three bladed bit. By increasing the cutter density or volume of primary cutters 514 on each blade 531, 532, 533, particularly in certain radial locations where the workload on each cutter is more pronounced, the cutters 514 wear at a slower rate for a faster ROP. Also, by providing the decreased number of blades 531, 532, 533 more nozzles may be provided for each blade in order to provide increased fluid flow and to handle more cuttings created from the material of the formation being drilled. By increasing the hydraulic horsepower provided from the nozzles to the blades to clean the cutters 514, the ROP is further increased. Moreover, by providing a rotary drag bit 510 with fewer blades and multiple rows of primary cutters, the hydraulic cleaning of the rotary drag bit 510 is enhanced to provide increased ROP while obtaining the durability of the conventional heavier bladed drag bit without the resultant lower ROP.

In one aspect of the rotary drag bit 510, a cutting structure of an X bladed drag bit is placed upon a Y bladed drag bit, where Y is less than X and the cutters 514 of the cutting structure are each coupled to the Y bladed drag bit on adjacent or partially overlapping rotational or helical paths. By providing the cutting structure of the X bladed drag bit upon the Y bladed drag bit, the durability of the X bladed drag bit is achieved on the Y bladed drag bit while achieving the higher penetration rate or efficiency of the Y bladed drag bit.

Figure 24:
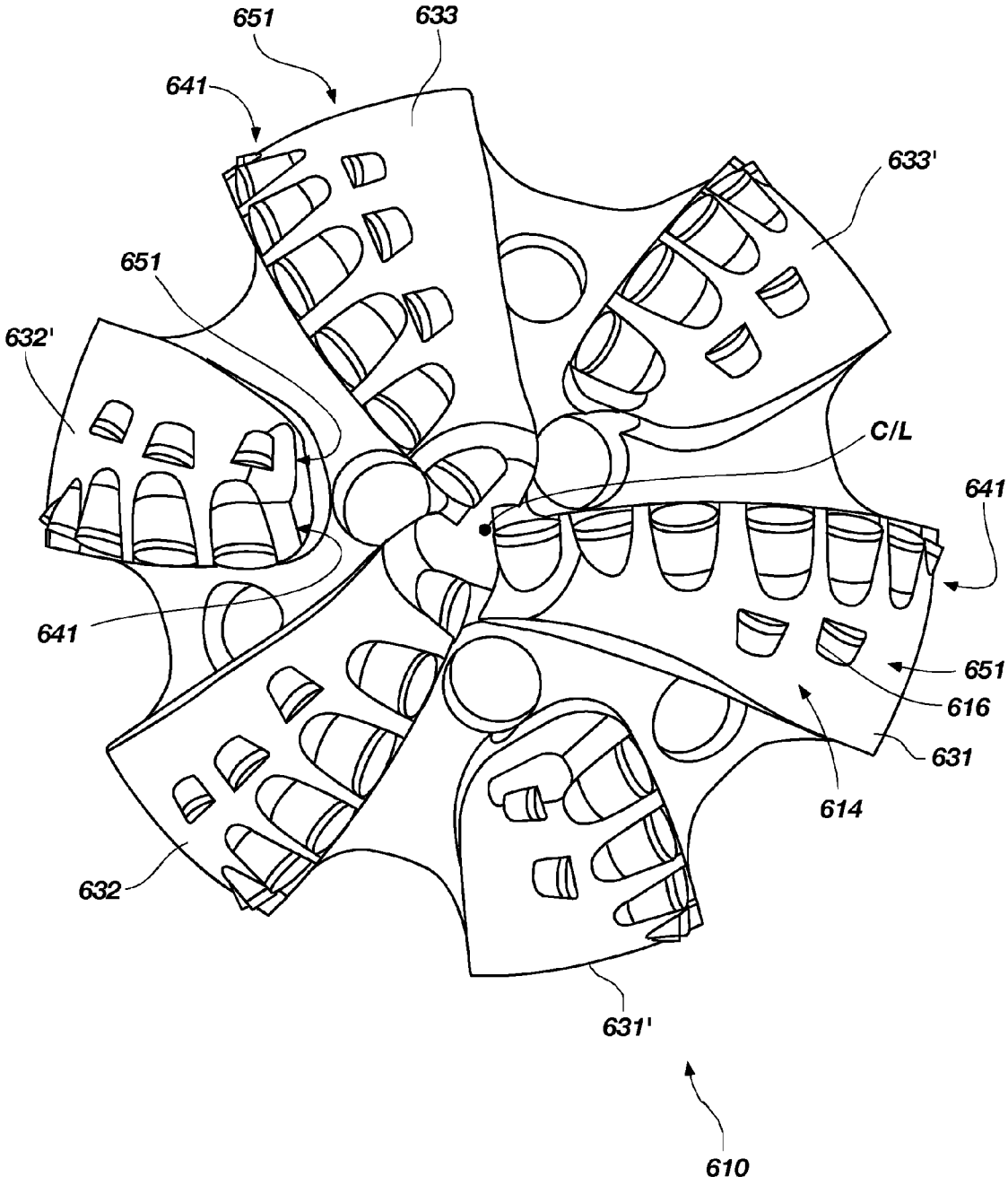
FIG. 24 shows a frontal view of a rotary drag bit in accordance with a fifth embodiment of the invention.

FIG. 24 shows a frontal view of a rotary drag bit 610 in accordance with another embodiment of the invention. The rotary drag bit 610 comprises six blades 631, 631', 632, 632', 633, 633' each comprising a primary or first cutter row 641 and a backup or second cutter row 651 extending from the center line C/L of the rotary drag bit 610. The cutter rows 641, 651 include cutters 614 coupled to cutter pockets 616 of the blades 631, 631', 632, 632', 633, 633'. It is contemplated that each blade 631, 631', 632, 632', 633, 633' may have more or fewer cutter rows 641, 651 than the two illustrated. Also, each of the cutter rows 641, 651 may have fewer or greater numbers of cutters 614 than illustrated on each of the blades 631, 631', 632, 632', 633, 633'. In this embodiment, blades 631, 632, 633 are primary blades and blades 631', 632', 633' are secondary blades. The secondary blades 631', 632', 633' provide support for adding additional cutters 614, particularly, in the nose or shoulder regions 662 (see FIG. 25) where the work requirement or potential for impact damage may be greater upon the cutters 614. The cutters 614 of the second cutter rows 651 provide backup support for the respective cutters 614 of the first cutter rows 641, respectively, should the cutters 614 become damaged or worn, and may also be selectively placed to share the work at different wear states of the cutters 614 of the first cutter rows 641.

In order to improve the life of the rotary drag bit 610, each of the cutters 614 of the second cutter rows 651 may be oriented inline, offset, underexposed, or staggered, or a combination thereof, for example, without limitation, relative to each of their respective cutters 614 of the first cutter row 641. In this regard, a cutter 614 of a second cutter row 651 may assist and support a cutter 614 of the first cutter row 641 by removing material from the formation and still provide backup support should the primary cutter 614 of the first cutter row 641 fail.

In this embodiment of the invention, the second cutter rows 651 include cutters 614 of different underexposures on each of the blades 631, 631', 632, 632', 633, 633'. The term "different" as used with the term "underexposed" or the term "underexposure" means that different cutters may have different extents of underexposures relative to anyone of the other cutters on the rotary drag bit 610, in this respect the cutters are said to be variably underexposed. By providing the cutters 614 that are differently underexposed, each cutter 614 may engage material of the formation at different wear states of the primary cutters 614 of the first cutter rows 641 while providing backup support therefor. Discussion of the second cutter rows 651 of the blades 631, 631', 632, 632', 633, 633' will now be taken in turn.

Figure 25:
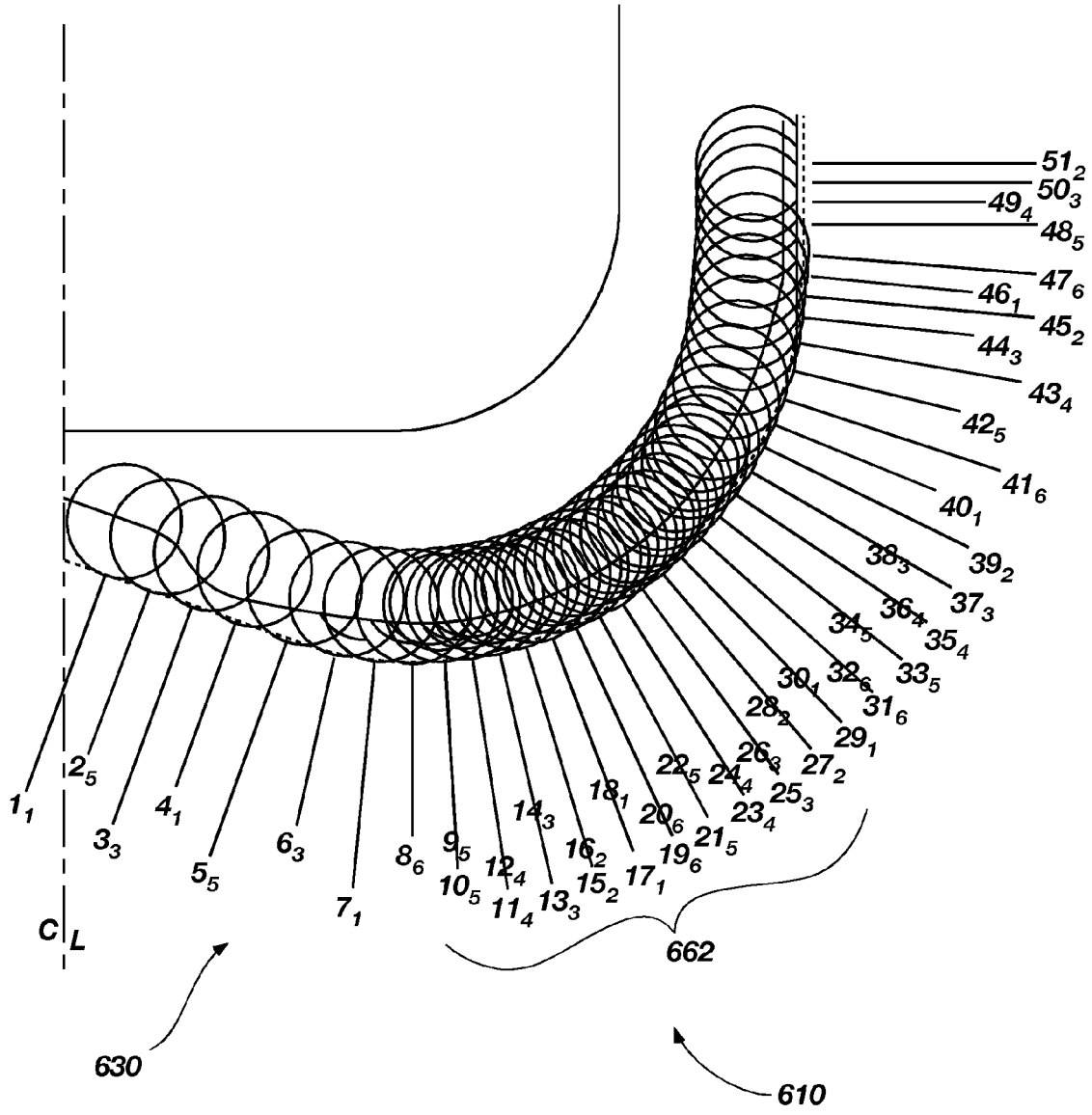
FIG. 25 shows a cutter and blade profile for the fifth embodiment of the invention.

FIG. 25 shows a cutter and blade profile 630 for the second embodiment of the invention. The rotary drag bit 610 has a cutter density of 51 cutters and a profile as represented by cutter and blade profile 630. The cutters 614 for purposes of the rotary drag bit 610 are numbered 1 through 51. The cutters 1-51, while they may include aspects of other embodiments of the invention, should not be confused with the numerically numbered cutters of the other embodiments of the invention. Specific cutter profiles for each of the blades 631, 631', 632, 632', 633, 633' are shown in FIGS. 26 through 31, respectively.

Figure 26:
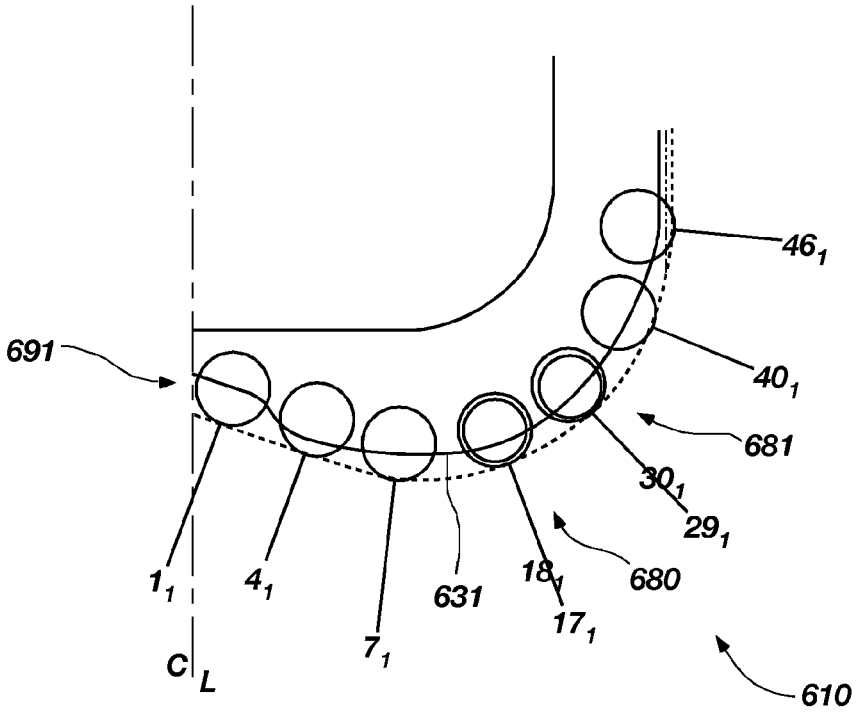
FIG. 26 shows a cutter profile for a first blade of the rotary drag bit of FIG. 24.

The blade 631 illustrated in FIG. 26 includes a second cutter row 651 and a first cutter row 641 having a second cutter 18 underexposed by fifty thousandths (0.050) of an inch (1.27 millimeters) rotationally trailing a fully exposed primary cutter 17, and a second cutter 30 underexposed by fifteen thousandths (0.015) of an inch (0.381 millimeters) rotationally trailing a fully exposed primary cutter 29, respectively. While the second cutters 18, 30 have different underexposures of fifty thousandths (0.050) of an inch (1.27 millimeters) and fifteen thousandths (0.015) of an inch (0.381 millimeters), respectively, in the second cutter row 631, they may have the greater or lesser amounts of underexposure, and may also have the same amount of underexposure. The cutters 17 and 18 form an underexposed cutter set 680. Likewise, the cutters 29 and 30 also form an underexposed cutter set 681. The second cutters 18 and 30 form an underexposed cutter row 691.

Figure 27:
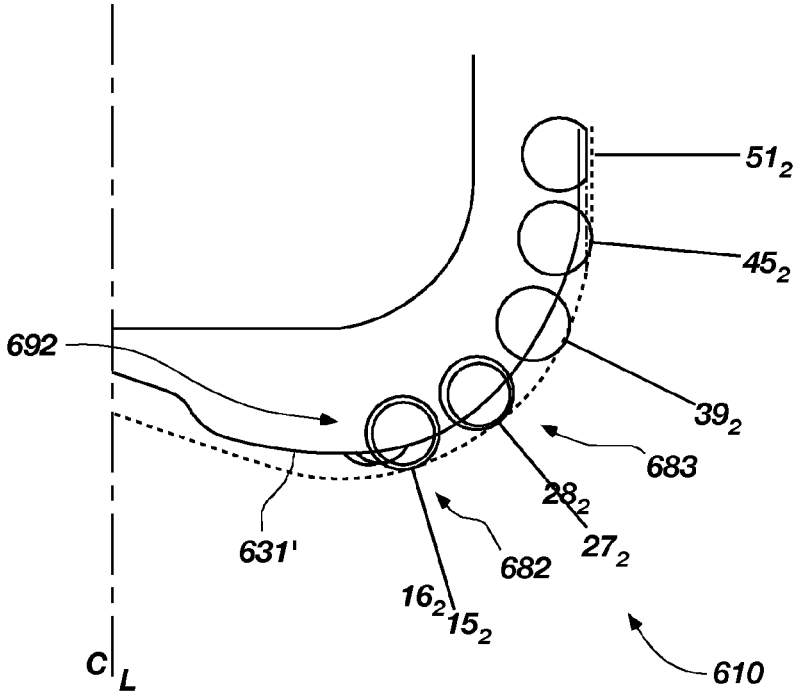
FIG. 27 shows a cutter profile for a second blade of the rotary drag bit of FIG. 24.

Illustrated in FIG. 27, the blade 631' comprising a second cutter row 651 and a first cutter row 641 includes a second cutter 16 underexposed by fifty thousandths (0.050) of an inch (1.27 millimeters) rotationally trailing a fully exposed primary cutter 15 and another second cutter 28 underexposed by fifteen thousandths (0.015) of an inch (0.381 millimeters) rotationally trailing a fully exposed primary cutter 27, respectively. While the second cutters 16, 28 have underexposures of fifty thousandths (0.050) of an inch (1.27 millimeters) and fifteen thousandths (0.015) of an inch (0.381 millimeters), respectively, in the second cutter row 631, they may have the greater or lesser amounts of underexposure, and may also have the same amount of underexposure. The cutters 15 and 16 form an underexposed cutter set 682. Likewise, the cutters 27 and 28 also form an underexposed cutter set 683. The second cutters 16 and 28 form an underexposed cutter row 692.

Figure 28:
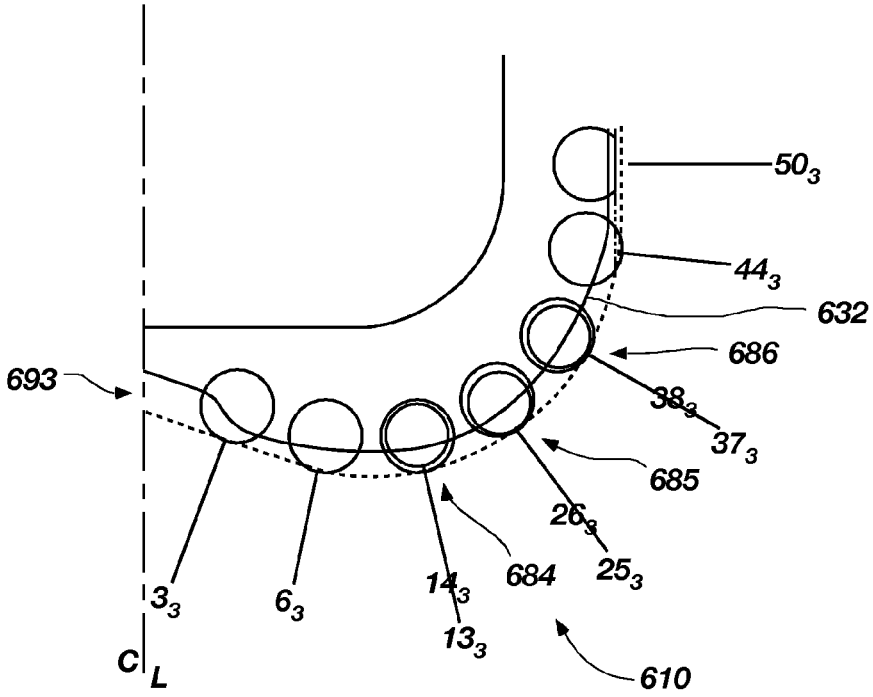
FIG. 28 shows a cutter profile for a third blade of the rotary drag bit of FIG. 24.

The blade 632 as illustrated in FIG. 28 comprises a second cutter row 651 and a first cutter row 641 that include second cutters 14, 26, 38 underexposed by fifty thousandths (0.050) of an inch (1.27 millimeters), twenty-five thousandths (0.025) of an inch (0.635 millimeters) and fifteen thousandths (0.015) of an inch (0.381 millimeters) rotationally trailing fully exposed primary cutters 13, 25 and 37, respectively. While the second cutters 14, 26, 38 have underexposures of fifty thousandths (0.050) of an inch (1.27 millimeters), twenty-five thousandths (0.025) of an inch (0.635 millimeters) and fifteen thousandths (0.015) of an inch (0.381 millimeters), respectively, in the second cutter row 651, they may have the greater or lesser amounts of underexposure, and may also have the same amount of underexposure. The cutters 13 and 14, 25 and 26, and 37 and 38, respectively form three underexposed cutter sets 684, 685, 686. The second cutters 14, 26, 38 form an underexposed cutter row 693.

Figure 29:
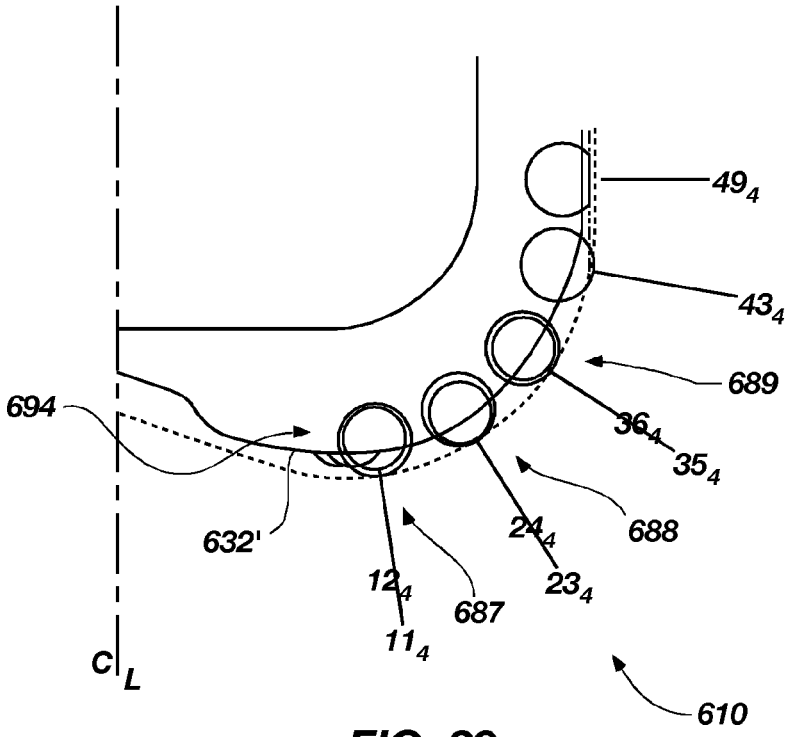
FIG. 29 shows a cutter profile for a fourth blade of the rotary drag bit of FIG. 24.
Figure 30:
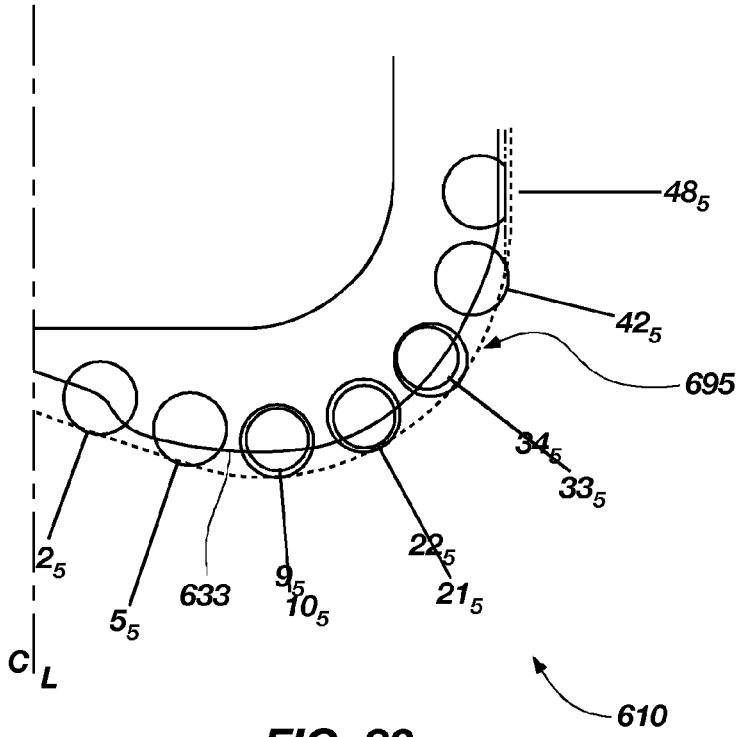
FIG. 30 shows a cutter profile for a fifth blade of the rotary drag bit of FIG. 24.
Figure 31:
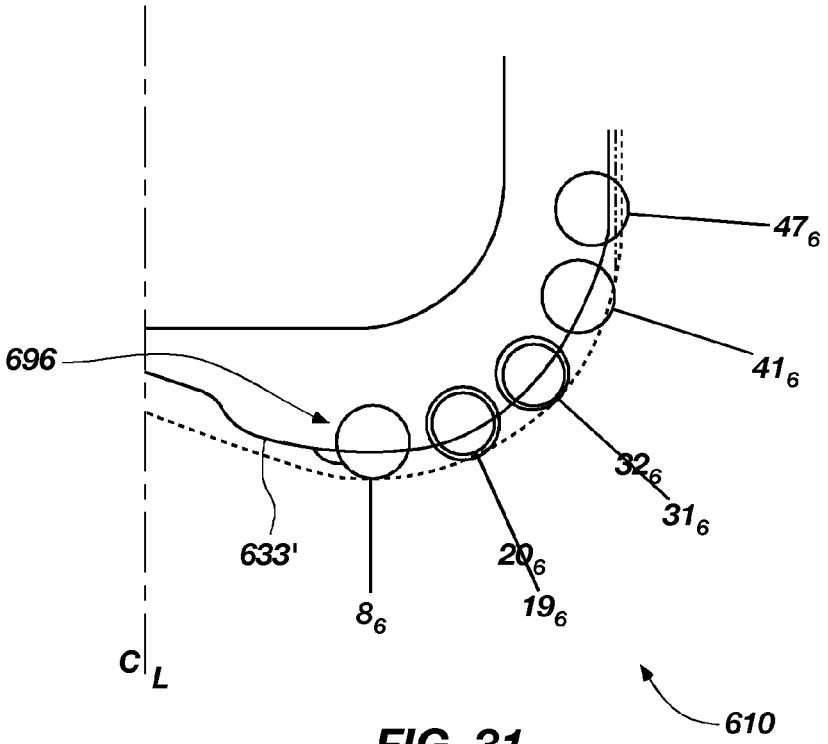
FIG. 31 shows a cutter profile for a sixth blade of the rotary drag bit of FIG. 24.

A second cutter row 651 of blade 632' as illustrated in FIG. 29 comprises second cutters 12, 24, 36 underexposed by fifty thousandths (0.050) of an inch (1.27 millimeters), fifteen thousandths (0.015) of an inch (0.381 millimeters) and twenty-five thousandths (0.025) of an inch (0.635 millimeters) rotationally trailing fully exposed primary cutters 11, 23 and 35, respectively, and forming an underexposed cutter row 694. Also as illustrated in FIG. 30, a second cutter row 651 of blade 633 comprises second cutters 10, 22, 34 underexposed by fifty thousandths (0.050) of an inch (1.27 millimeters), twenty-five thousandths (0.025) of an inch (0.635 millimeters) and fifty thousandths (0.050) of an inch (1.27 millimeters) rotationally trailing fully exposed primary cutters 9, 21 and 33, respectively, and forming an underexposed cutter row 695. Further, a second cutter row 651 of blade 633' as illustrated in FIG. 31 comprises second cutters 20, 32 underexposed by twenty-five thousandths (0.025) of an inch (0.635 millimeters) and fifteen thousandths (0.015) of an inch (0.381 millimeters) rotationally trailing fully exposed primary cutters 19 and 31, respectively, and forming an underexposed cutter row 696. While various arrangements of second cutters 614 are arranged in the underexposed cutter rows 691 through 696 of blades 631, 631', 632, 632', 633, 633' of the rotary drag bit 610, it is contemplated that one or more second cutters may be provided having more or less underexposure for engagement with the material of a formation set for different wear stages of the primary cutters illustrated in rows 641. In this regard, second cutters 10, 12, 14, 16, and 18 may engage the material of the formation when substantial wear or damage occurs to their respective primary cutters 614, while second cutters 24, 28, 30 and 32 may engage the material of the formation when wear begins to develop on respective primary cutters 614 irrespective of damage thereto.

In accordance with embodiments of the invention, a plurality of secondary cutting elements may be differently underexposed in one or more backup cutter rows radially extending outward from the centerline C/L of the rotary drag bit 610 in order to provide a staged engagement of the cutting elements with the material of a formation as a function of the wear of a plurality of primary cutting elements. Also, the secondary cutting elements may be differently underexposed in one or more backup cutter rows to provide backup coverage to the primary cutters in the event of primary cutter failure.

Figure 32:
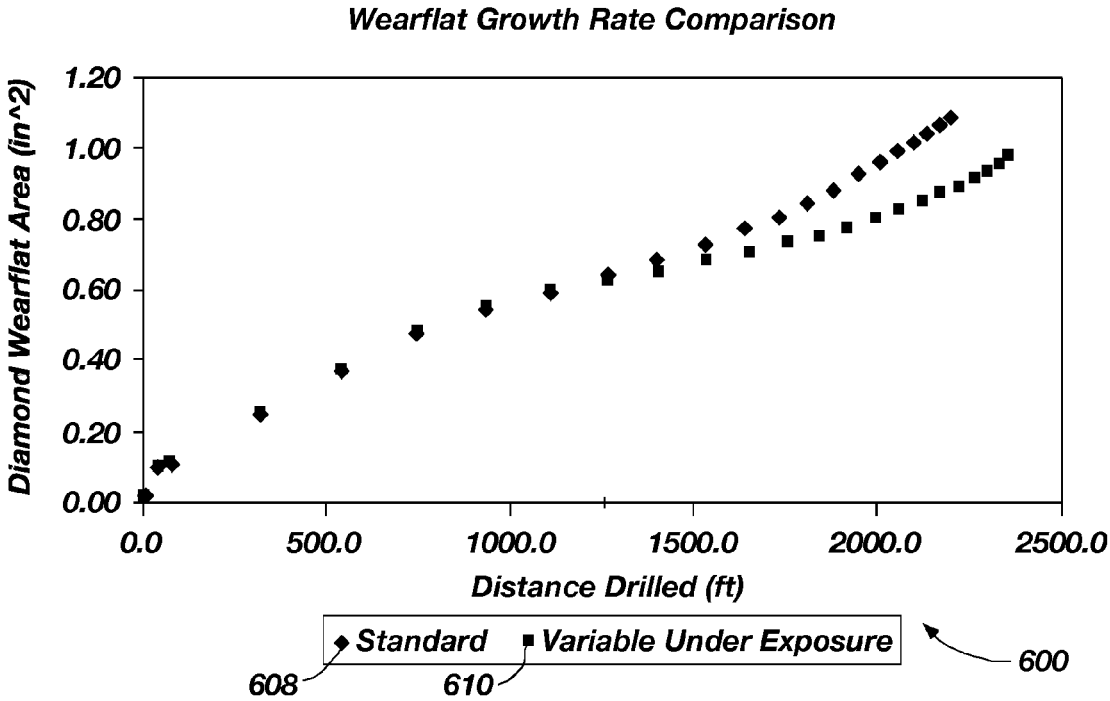
FIG. 32 is a graph of cumulative diamond wearflat area during simulated drilling conditions for two different rotary drag bits over distance drilled.
Figure 33:
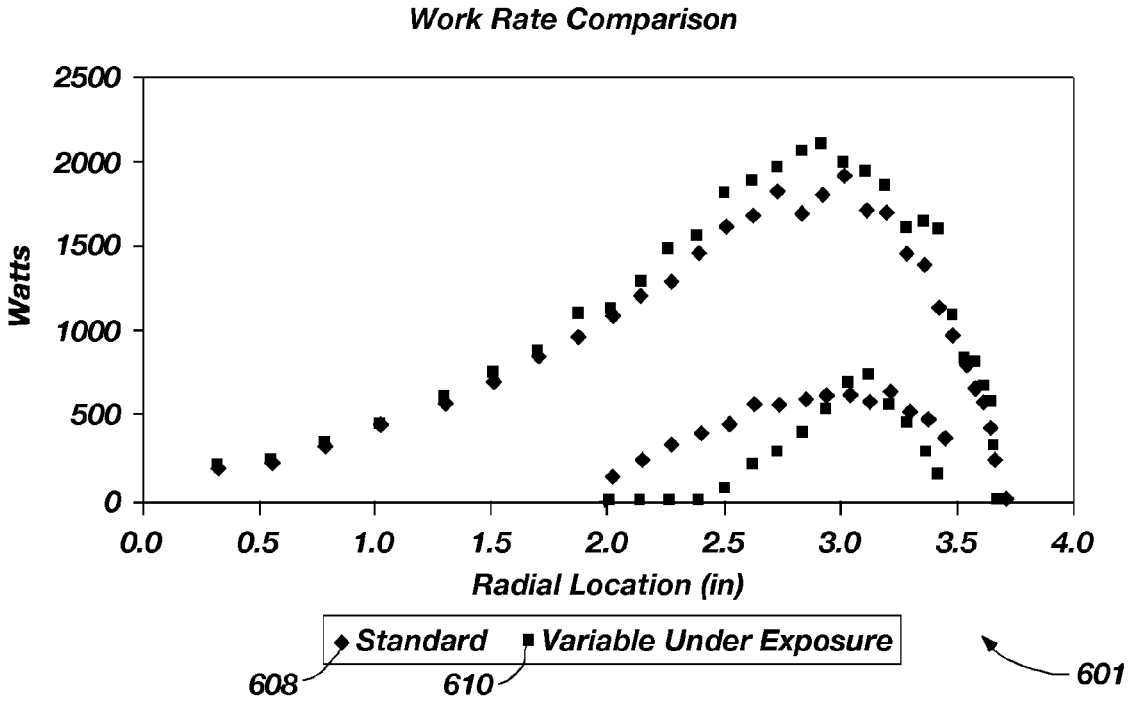
FIG. 33 is a graph of work rate of the simulated drilling conditions of FIG. 32.
Figure 34:
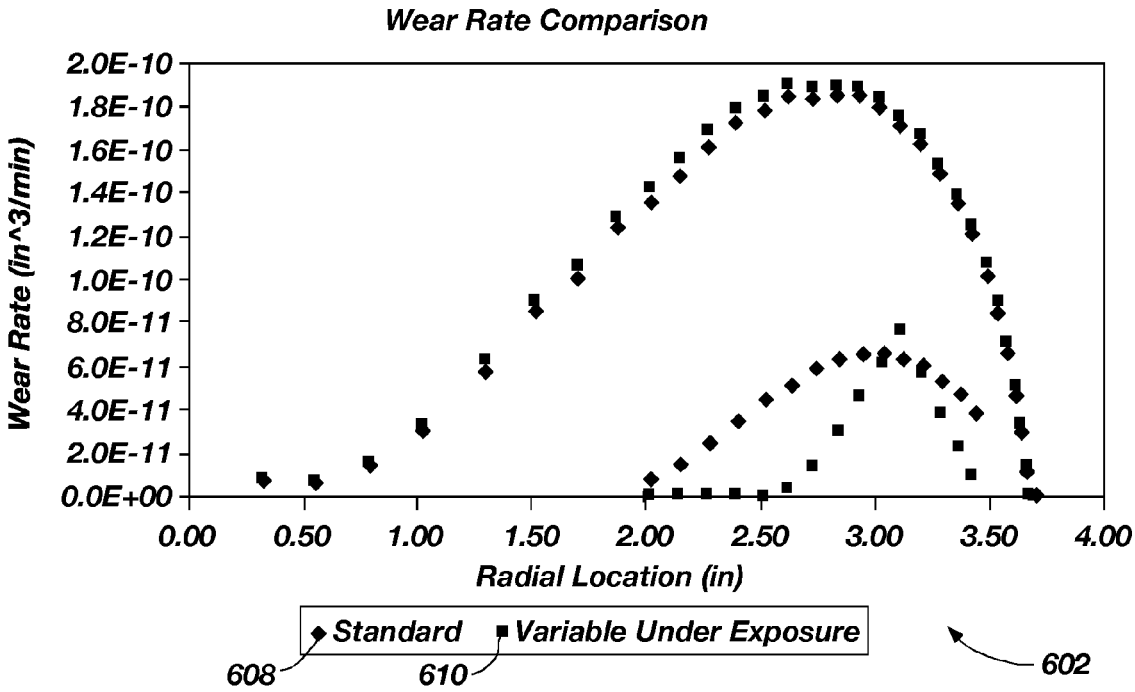
FIG. 34 is a graph of wearflat rate for each cutter as a function of cutter radial position for the simulated drilling conditions of FIG. 32 at the end of the simulation.

In FIGS. 32, 33 and 34, the results, as portrayed, are identified by reference to the numeral given to each drag bit 608 and 610. FIG. 32 is a graph 600 of cumulative diamond wearflat area during simulated drilling conditions for a conventional drag bit 608 and a rotary drag bit 610. The conventional drag bit 608 includes six blades having a primary and a backup row of cutters on each of the blades, where the underexposure of the backup row of cutters is constant. The rotary drag bit 610 is shown in FIG. 25 and described above. The graph 600 of FIG. 32 includes a vertical axis indicating total diamond wearflat area of all the cutting elements in square inches (by 645.16 in square millimeters), and a horizontal axis indicating distance drilled in feet (by 0.3048 in meters). FIG. 32 shows the differences in the amount of wearflat area and that the wearflat rate (slope) over the life of the bit is influenced by the cutting structure layout upon the drag bits 608, 610. For example, within the first stage or 1200 feet (366 meters) of drilling, the wearflat rate for both bits 608, 610, i.e., slopes of the curves, are similar. As the bits 608, 610 continue to drill beyond 1200 feet (366 meters), the cutters of the conventional bit 608 wear at an increased rate, whereas the cutters of the novel rotary drag bit 610 that incorporate teachings of the present invention wear at a slower rate as the underexposure of the backup cutters begin to engage the material of the formation to help optimize the load and wear upon each of the cutters. The different underexposed backup cutters of the rotary drag bit 610 allow for further drilling distance as compared to a comparable conventional bit 608. By providing one or more underexposed cutter rows on one or more blades of a drag bit, the wearflat rate of the cutters may provide for enhanced performance in terms of total wear and depth of drilling.

FIG. 33 is a graph 601 of work rate of the simulated drilling conditions of FIG. 32. The graph 601 of FIG. 33 includes a vertical axis indicating work load for each cutting element in watts, and a horizontal axis indicating the radial position of cutting element from the center of the drag bit in inches (by 25.4 in millimeters). This graph 601 shows the work load on each cutting element at the end of drilling the material of a formation. Advantageously, because the cutters of the rotary drag bit 610 include differently underexposed second cutters, only specific second cutters engaged the formation as the primary cutter wore or were damaged. Thus, the second cutters of the rotary drag bit 610 were subject to work only when a primary cutter was damaged or when a staged amount of wear developed upon the primary cutter. However, all of the backup cutters of the conventional bit 608 were undesirably subjected to work regardless of the amount of wear upon its primary cutters, thereby resulting in less than optimal performance. By providing each backup cutter with a different amount of underexposure, the wear upon the primary cutters may be optimized to enhance the work upon each cutter while extending the usable life of the bit.

FIG. 34 is a graph 602 of wear rate for each cutter as a function of cutter radial position for the simulated drilling conditions of FIG. 32. The graph 602 of FIG. 34 includes a vertical axis indicating diamond wear rate of each cutting element in square inches per minute (by 25.4 in millimeters per minute), and a horizontal axis indicating the radial position of cutting element from the center of the drag bit in inches (by 25.4 in millimeters). The graph 602 indicates the wear rate of each cutting element or cutter for each of the drag bits 608, 610 at the end of the simulation. Of interest, the different underexposed cutters experienced a designed or staged amount of cutter wear, lessening the wear upon the primary cutters while increasing or optimizing the life of the rotary drag bit 610, and still providing backup cutter protection should a primary cutter fail. However, all of the backup cutters of the conventional bit 608 were unnecessarily exposed to the formation regardless of the wear state of the primary cutters, thereby wearing at an increased rate compared to the cutters of rotary drag bit 610. By providing the different underexposed cutters, the wear rate (slope of the curve in FIG. 32) of the rotary drag bit 610 increases at a slower rate to extend the life of all the cutters and, thus, achieves greater drilling depth. Moreover, the graph 602 shows that the life of the rotary drag bit 610 may be extended while providing backup cutters that may engage the material of a formation when a primary cutter falls or when a particular wear state is achieved on select primary cutters 614.

Figure 35:
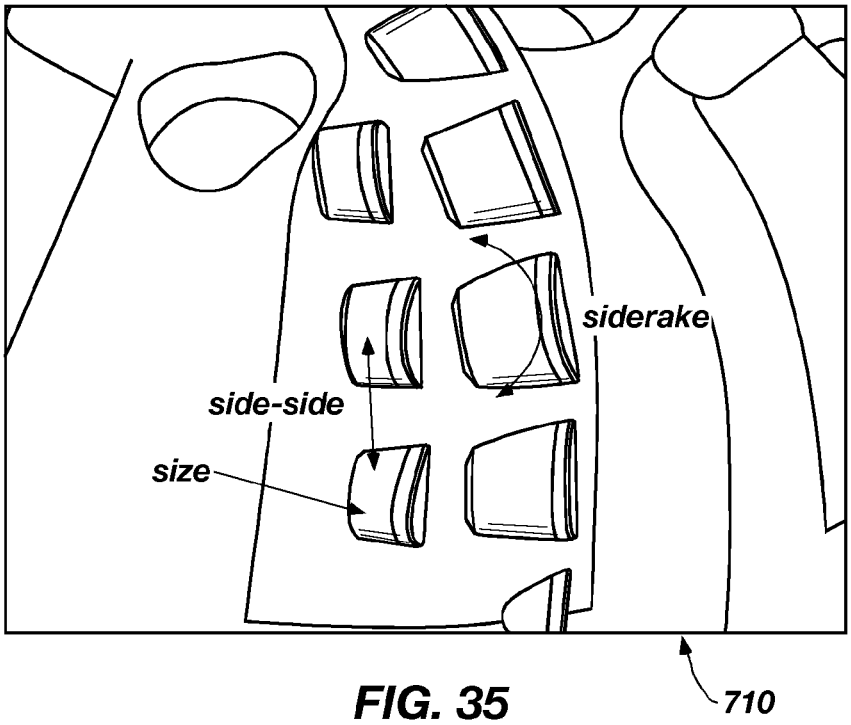
FIG. 35 shows a partial top view of a rotary drag bit.
Figure 36:
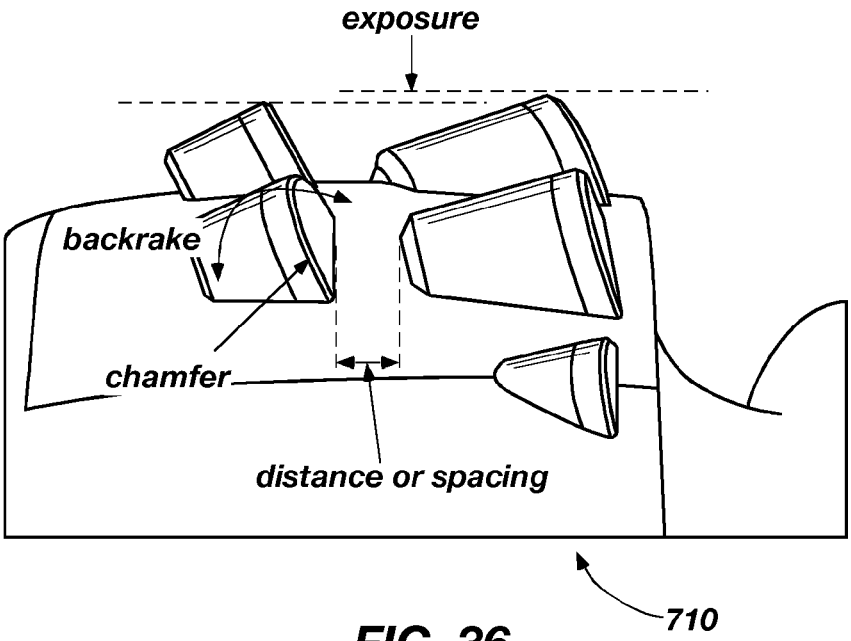
FIG. 36 shows a partial side view of the rotary drag bit of FIG. 35.

FIG. 35 shows a partial top view of a rotary drag bit 710 showing the concept of cutter siderake (siderake), cutter placement (side-side), and cutter size (size). "Siderake" is described above. "Side-side" is the amount of distance between cutters in the same cutter row. "Size" is the cutter size, typically indicated in by the cutters' facial length or diameter. FIG. 36 shows a partial side view of the rotary drag bit 710 of FIG. 35 showing concepts of backrake, exposure, chamfer and spacing as described herein.

In the embodiments of the invention described above, selected cutter configurations and cutter orientation for cutters placed upon a rotary drag bit have been explored. The select cutter configurations may be optimized to have placement based upon optimizing depth-of-cut and rock removal strategy. Such a strategy would enable design of a cutting structure having the most optimal load sharing and vibration mitigation between select primary and backup cutters. Conventionally, backup cutters are placed upon a drag bit at a set distance behind with a uniform underexposure with respect to the primary cutters that they follow. By implementing a rock removal strategy, the placement of the primary cutters and secondary cutters may be optimized to effectively balance the load and rock removal of the drag bit for improved performance and life. Essentially, the placement of each cutter in cutter rows upon a blade of a drag bit is optimized to provide the optimal siderake, cutter placement, cutter size, backrake, exposure, chamfer or spacing with respect to the other cutters in order to facilitate the optimization of the drag bit for drilling faster further.

In the embodiments of the invention described above, a rotary drag bit includes backup cutter configurations having different backrake angles and siderake angles, as described herein, positioned in select locations on the bit with respect to primary cutters in order to prolong the usable service life of the cutters by limiting vibrational effects and dysfunctional energy during drilling. In this regard, it is understood that varying backrake and siderake angles of the backup cutters in relationship to the primary cutters or other backup cutters provides for improved balancing of cutter forces and promotes a smoother work rate for the drill bit as described herein above. Accordingly, by varying backrake and siderake angles of the backup cutters in the profile of the cutting element provides for enhanced vibration mitigation during formation drilling, particularly when dynamic dysfunctions occur, and increased cutting action as the cutting elements wear.

While particular embodiments of the invention have been shown and described, numerous variations and alternate embodiments will occur to those skilled in the art. Accordingly, it is intended that the invention be limited only in terms of the appended claims and their legal equivalents.

What is claimed is:

1. A rotary drag bit, comprising:

a bit body with a face and an axis;

at least one blade extending radially and longitudinally over the face;

a primary cutter row comprising at least one primary cutter, the at least one primary cutter including a cutting surface protruding at least partially from the at least one blade, located to traverse a cutting path upon rotation of the bit body about the axis, and configured to engage a formation upon movement along the cutting path; and a backup cutter group comprising a first trailing cutter row and a second trailing cutter row, each trailing cutter row comprising at least one cutter including a cutter configuration and a cutting surface protruding at least partially from the at least one blade, the at least one cutter of each of the first and second trailing cutter rows positioned so as to substantially follow the at least one primary cutter along the cutting path upon rotation of the bit body about its axis, and each cutter configured to selectively engage the formation upon movement along the cutting path; and wherein the cutter configuration of the at least one cutter of the first trailing cutter row is oriented at least one of:

a different backrake angle from a backrake angle of the at least one cutter of the second trailing cutter row; and a different siderake angle from a siderake angle of the at least one cutter of the second trailing cutter row.

2. The rotary drag bit of claim 1, wherein the cutter configuration of the at least one cutter of the first trailing cutter row is oriented at a different backrake angle from a backrake angle of the at least one cutter of the second trailing cutter row.

3. The rotary drag bit of claim 1, wherein the cutter configuration of the at least one cutter of the first trailing cutter row is oriented at a different backrake angle and a different siderake angle from a backrake angle and a siderake angle of the at least one cutter of the second trailing cutter row.

4. The rotary drag bit of claim 3, wherein the at least one cutter of the first trailing cutter row is underexposed with respect to an exposure of the at least one primary cutter.

5. The rotary drag bit of claim 3, wherein the at least one cutter of the second trailing cutter row is underexposed with respect to an exposure of the at least one cutter of the first trailing cutter row.

6. The rotary drag bit of claim 1, wherein the blade is a primary blade comprising a blade surface and a leading face, the primary cutter row being aligned substantially along the leading face.

7. The rotary drag bit of claim 1, wherein the first and second trailing cutter rows are backup cutter rows, each backup cutter row comprising the at least one cutter.

8. The rotary drag bit of claim 1, wherein the at least one cutter of the first and second trailing cutter rows are backup cutters and have cutting surfaces with smaller than an exposure of the cutting surface of the at least one primary cutter.

9. The rotary drag bit of claim 1, wherein the at least one cutter of both of the first and second trailing cutter rows have cutting surfaces of substantially a same size.

10. The rotary drag bit of claim 1, wherein either of the first and second trailing cutter rows rotationally follows the primary cutter row on another blade than the at least one blade associated with the primary cutter row.

11. The rotary drag bit of claim 1, wherein the at least one primary cutter and the at least one cutter of each of the first and second trailing cutter rows are polycrystalline diamond compact cutters.

12. A rotary drag bit, comprising:

a bit body with a face and an axis;

at least one blade extending radially and longitudinally over the face;

a primary cutter row comprising a plurality of primary cutters, each of the plurality of primary cutters including a cutting surface protruding at least partially from the at least one blade, located to traverse a cutting path upon rotation of the bit body about the axis, and configured to engage a formation upon movement along the cutting path;

a first trailing cutter row comprising at least one first cutter including a first cutter configuration and a cutting surface protruding at least partially from the at least one blade, positioned so as to substantially follow at least one of the plurality of primary cutters along the cutting path, and configured to conditionally engage the formation upon movement along the cutting path; and a second trailing cutter row comprising at least one second cutter including a second cutter configuration different from the first cutter configuration and a cutting surface protruding at least partially from the at least one blade, positioned so as to substantially follow at least one of the plurality of primary cutters along the cutting path, and configured to conditionally engage the formation upon movement along the cutting path; and wherein the first and second cutter configurations comprise at least one of:

a siderake angle of the at least one first cutter varied to a different extent than a siderake angle of the at least one second cutter; and a backrake angle of the at least one first cutter varied to a different extent than a backrake angle of the at least one second cutter.

13. The rotary drag bit of claim 12, wherein the first and second cutter configurations comprise a first siderake angle of the at least one first cutter varied to a different extent than a siderake angle of the at least one second cutter.

14. The rotary drag bit of claim 12, wherein the first and second cutter configurations comprise a backrake angle and a siderake angle of the at least one first cutter varied to a different extent with respect to a backrake angle and a siderake angle of the at least one second cutter.

15. The rotary drag bit of claim 12, wherein the at least one first cutter of the first trailing cutter row and the at least one second cutter of the second trailing cutter row are underexposed with respect to a corresponding primary cutter of the plurality of primary cutters.

16. The rotary drag bit of claim 15, wherein the at least one first cutter of the first trailing cutter row is underexposed to a lesser extent with respect to an exposure of the at least one second cutter of the second trailing cutter row.

17. The rotary drag bit of claim 15, wherein the at least one first cutter of the first trailing cutter row is underexposed to a greater extent with respect to an exposure of the at least one second cutter of the second trailing cutter row.

18. A rotary drag bit, comprising:

a bit body with a face and an axis;

at least one blade extending radially and longitudinally over the face; and a primary cutter row comprising at least one primary cutter, the at least one primary cutter including a cutting surface protruding at least partially from the at least one blade, located to traverse a cutting path upon rotation of the bit body about the axis, and configured to engage a formation upon movement along the cutting path; and a backup cutter row comprising a plurality of backup cutters comprising a first backup cutter rotationally following the at least one primary cutter, and a second backup cutter oriented differently than the first backup cutter, the first backup cutter and the second backup cutter including a cutting surface protruding at least partially from the at least one blade, configured to conditionally engage a formation upon movement along the cutting path; and wherein the second backup cutter has at least one of:

a different backrake angle than the first backup cutter; and a different siderake angle than the first backup cutter.

19. The rotary drag bit of claim 18, wherein the second backup cutter has a different backrake angle than the first backup cutter.

20. The rotary drag bit of claim 18, wherein the second backup cutter has a different backrake angle and siderake angle than the first backup cutter.

21. The rotary drag bit of claim 18, wherein the backup cutter row comprises a third backup cutter oriented with respect to either of the first backup cutter and the second backup cutter.

22. The rotary drag bit of claim 18, wherein the second backup cutter is underexposed to a greater extent than the first backup cutter.

23. The rotary drag bit of claim 15, wherein the second backup cutter is underexposed to a lesser extent than the first backup cutter.

24. A rotary drag bit, comprising:

a bit body with a face and an axis;

at least one blade extending radially and longitudinally over the face;

a primary cutter row comprising a first primary cutter and a second primary cutter, each primary cutter including a cutting surface protruding at least partially from the at least one blade, located to traverse a cutting path upon rotation of the bit body about the axis, and configured to engage a formation upon movement along the cutting path;

a first backup cutter rotationally following the first primary cutter, the first backup cutter including a cutting surface protruding at least partially from the at least one blade, configured to conditionally engage a formation upon movement along the cutting path; and a second backup cutter rotationally following the second primary cutter and oriented differently than the first backup cutter, the second backup cutter including a cutting surface protruding at least partially from the at least one blade, configured to conditionally engage a formation upon movement along the cutting path; and wherein the second backup cutter has at least one of:

a different backrake angle than the first backup cutter; and a different siderake angle than the first backup cutter.

25. The rotary drag bit of claim 24, wherein the second backup cutter is underexposed to a lesser extent than the first backup cutter.

26. A rotary drag bit, comprising:

a bit body with a face and an axis;

at least one blade extending radially and longitudinally over the face;

a plurality of primary cutters, each primary cutter of the plurality of primary cutters including a cutting surface protruding at least partially from the at least one blade, located to traverse a cutting path upon rotation of the bit body about the axis, and configured to engage a formation upon movement along the cutting path;

a first backup cutter rotationally following a primary cutter of the plurality of primary cutters, the first backup cutter including a first siderake angle, a first backrake angle, and a cutting surface protruding at least partially from the at least one blade, configured to conditionally engage a formation upon movement along the cutting path; and a second backup cutter rotationally following another primary cutter of the plurality of primary cutters, the second backup cutter including a different second siderake angle than the first siderake angle, a different second backrake angle than the first backrake angle, and a cutting surface protruding at least partially from the at least one blade, configured to conditionally engage a formation upon movement along the cutting path.

27. The rotary drag bit of claim 26, wherein the second backup cutter is in the same cutter row as the first backup cutter.

28. The rotary drag bit of claim 26, wherein the second backup cutter is underexposed to a greater extent than the first backup cutter.

29. The rotary drag bit of claim 26, wherein the second backup cutter is underexposed to a lesser extent than the first backup cutter.

30. A method of designing a rotary drag bit, comprising:

configuring a bit body having a face, an axis, at least one blade extending radially and longitudinally over the face, and a plurality of primary cutters, each primary cutter of the plurality of primary cutters including a cutting surface protruding at least partially from the at least one blade, located to traverse a cutting path upon rotation of the bit body about the axis, and configured to engage a formation upon movement along the cutting path;

configuring a first backup cutter rotationally trailing a primary cutter of the plurality of primary cutters, the first backup cutter including a first siderake angle, a first backrake angle, and a cutting surface protruding at least partially from the at least one blade, configured to conditionally engage a formation upon movement along the cutting path; and configuring a second backup cutter rotationally following another primary cutter of the plurality of primary cutters, the second backup cutter including a different second siderake angle than the first siderake angle, a different second backrake angle than the first backrake angle, and a cutting surface protruding at least partially from the at least one blade, configured to conditionally engage a formation upon movement along the cutting path.

31. The method of claim 30, wherein the second backup cutter is configured to protrude from another blade relative to a primary cutter of the plurality of primary cutters.

32. The method of claim 30, further comprising configuring the second backup cutter underexposed to a lesser extent than the first backup cutter.

33. A method of using a rotary drag bit, comprising:

disposing a rotary drag bit to drill a borehole, the rotary drag bit comprising a bit body having a face, an axis, at least one blade extending radially and longitudinally over the face, and a plurality of primary cutters, each primary cutter of the plurality of primary cutters including a cutting surface protruding at least partially from the at least one blade, located to traverse a cutting path upon rotation of the bit body about the axis, and configured to engage a formation upon movement along the cutting path, a first backup cutter rotationally trailing a primary cutter of the plurality of primary cutters, the first backup cutter including a first siderake angle, a first backrake angle, and a cutting surface protruding at least partially from the at least one blade, configured to conditionally engage a formation upon movement along the cutting path, and a second backup cutter rotationally following another primary cutter of the plurality of primary cutters, the second backup cutter including a different second siderake angle than the first siderake angle, a different second backrake angle than the first backrake angle, and a cutting surface protruding at least partially from the at least one blade, configured to conditionally engage a formation upon movement along the cutting path; and drilling the borehole with the rotary drag bit.

* * * * *

UNITED STATES PATENT AND TRADEMARK OFFICE

CERTIFICATE OF CORRECTION

PATENT NO. : 7,762,355 B2
APPLICATION NO. : 12/020492
DATED : July 27, 2010
INVENTOR(S) : Eric E. McClain et al.

It is certified that error appears in the above-identified patent and that said Letters Patent is hereby corrected as shown below:

In the specification:

COLUMN 17, LINE 29, change “drag” to --rotary drag--

In the claims:

CLAIM 6, COLUMN 26, LINE 18, change “blade” to --at least one blade--

Signed and Sealed this
Twenty-fourth Day of September, 2013

Teresa Stanek Rea
*Deputy Director of the United States Patent and Trademark Office*